US005769015A

United States Patent [19]

Kato

[11] Patent Number: 5,769,015

[45] Date of Patent: Jun. 23, 1998

[54] AUTOMATIC CURTAIN PLEAT SEWING APPARATUS

[75] Inventor: Koshimi Kato, Aichi, Japan

[73] Assignee: Nakanihon Juki Co., Ltd., Aichi, Japan

[21] Appl. No.: 758,917

[22] Filed: Dec. 2, 1996

[30] Foreign Application Priority Data

Aug. 1, 1996 [JP] Japan ..... 8-203665

[51] Int. Cl.[6] ..... D05B 19/12; D05B 35/08

[52] U.S. Cl. ..... 112/470.04; 112/470.05; 112/134; 112/144; 223/30

[58] Field of Search ..... 112/470.01, 470.03, 112/470.04, 470.05, 475.02, 475.04, 475.06, 475.08, 144, 145, 146, 147, 163, 164; 223/28, 30, 32

[56] References Cited

U.S. PATENT DOCUMENTS 4,073,246 2/1978 Crawford et al. ..... 223/30 X
4,079,682 3/1978 Nishiwaki ..... 223/30
4,515,097 5/1985 Rovin ..... 112/475.06
5,148,760 9/1992 Miyauchi ..... 112/144

FOREIGN PATENT DOCUMENTS 8-38767 2/1996 Japan .
8-155169 6/1996 Japan .

*Primary Examiner*—Peter Nerbun
*Attorney, Agent, or Firm*—Morgan, Lewis & Bockius LLP

[57] ABSTRACT

An automatic curtain pleat sewing apparatus for forming and sewing pleats for a curtain, comprising: a sewing machine having sewing needles; a pleat forming-supplying unit having forepart holding plates for holding the leading end portion of the curtain fabric and the remainder thereof; pleat folding plates for pleating the curtain fabric thus held by the forepart holding plates; a pleat portion supply unit for integrally rotating the forepart holding plates and the pleat folding plates so as to insert the pleated portion of the curtain fabric in the sewing part of the sewing machine; a rear-end holding unit capable of moving the rear end portion of the curtain fabric forward and backward while holding the rear end portion thereof; and a full-width measuring unit capable of measuring the full width of the curtain fabric when the rear-end holding unit moves backward.

9 Claims, 15 Drawing Sheets

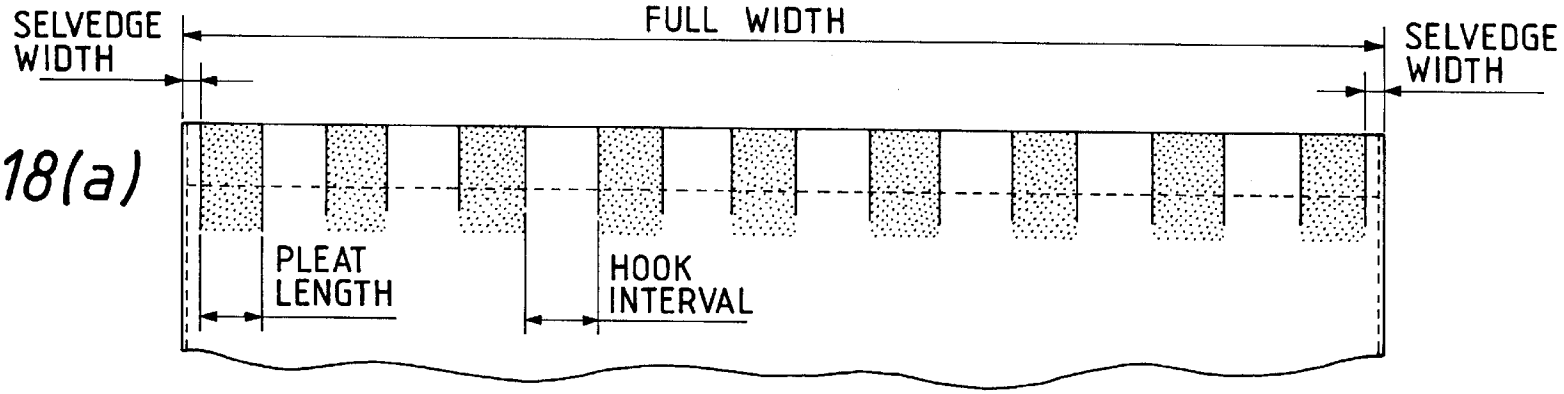
FIG. 18(a)
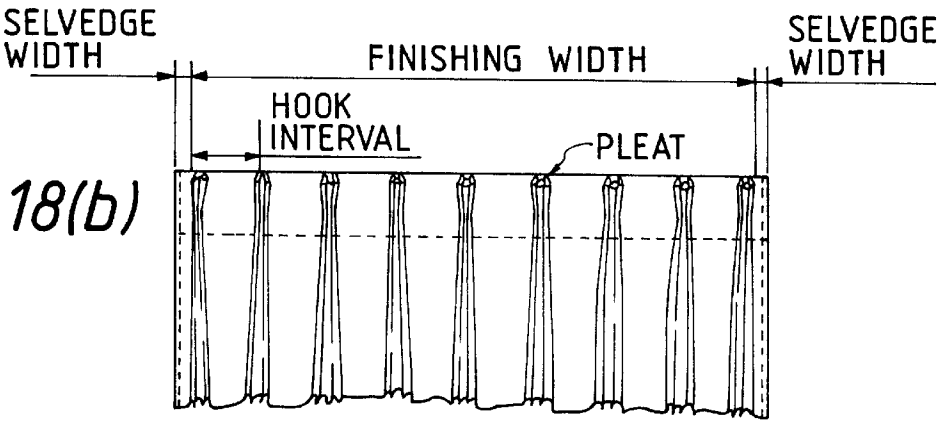
FIG. 18(b)
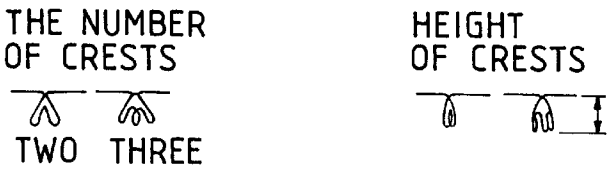
FIG. 18(c)
FIG. 18(d)
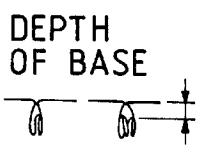
FIG. 18(e)

AUTOMATIC CURTAIN PLEAT SEWING APPARATUS

BACKGROUND OF THE INVENTION

The present invention relates to an automatic curtain pleat sewing machine or apparatus. More specifically, an automatic curtain pleat sewing machine suitable for manufacturing curtains on order.

Recently, demand for curtains made to order is on the increase.

Pleated curtains based on order production are expected to offer high-class as well as luxurious feeling and therefore material fabric to be used for the purpose is of good quality and made thicker than ready-made goods. Moreover, such pleated curtains on order use more material than ready-made ones because three or two crests are formed in each pleat set together with the increased number of pleats.

A plurality of crests in each pleat set are required to be uniform in height and kept from falling down or getting out of shape. The pleat sets have to be extended in a direction perpendicular to fabric and also parallel to each other and spaces between pleat sets have to be constant and free from irregularity. In particular, finishing dimensions in the width direction need to precisely conform to the lateral dimensions of windows in houses of those who have placed orders and, besides, pleated curtains are to be manufactured under conditions in which slightly longer curtains are overlooked, whereas any shorter ones are rejected.

FIG. 18 is intended to explain the terms used for curtains in this specification.

In an upper elevational view of fabric of FIG. 18(*a*), full width means the total width of curtain fabric whose both ends are subjected to a three-times lapping seam; selvedge width means lateral width between the endmost of the fabric and a place where pleat sewing is made; pleat length means the length of the fabric used as a pleat; and a hook interval (also called a tack space) means the space between pleats.

In an upper elevational view of pleated fabric of FIG. 18(*b*), finishing width means width resulting from excluding both selvedge widths from the full width of the pleated fabric; the number of pleats means the number of pleats sewn in one sheet of curtain (9 places in the example shown).

As in an edge face diagram illustrating a difference in the number of crests of FIG. 18(*c*), there are two or three crests and as shown in an edge face diagram illustrating the height of crests of FIG. 18(*d*), the height of a crest means the length between the top of the pleat crest and the pleat sewn. As shown in an edge face diagram illustrating the depth of a base of FIG. 18(*e*), the depth of a base means the length between the base of a pleat crest and the pleat sewn.

With respect to pleats to be formed and supplied during the sewing operation of a curtain, the present inventors have already proposed a pleat forming-supplying apparatus with the view of eliminating not only errors in between space-to-space dimensions and the whole finishing width arising from the measurement of necessary dimensions made a plurality of times while fabric is being fed but also dimensional and formative non-uniformity of crests and bases of pleats.

In Japanese Patent Application Laid-Open No. Hei. 8-38767 and No. Hei. 8-155169, the aforementioned pleat forming-supplying apparatus are designed to form pleats through the steps of: vertically holding the length required to form crests and bases of a pleat from both lateral sides, which length of a portion forms part of curtain fabric placed horizontally with pleat-set spaces provided outward from the sewing part of a sewing machine; perpendicularly curving upward the fabric by setting the left and right sides of the fabric thus clamped horizontally closer to the intermediate portion; perpendicularly forming a plurality of crests and bases in the curved pleat and holding the pleat; turning the fabric holding the crests and bases counterclockwise by 90° so as to horizontally position the top of each crest toward the sewing part of the sewing machine; horizontally moving and supplying the pleat thus rotated to the sewing part of the sewing machine, releasing part of the fabric clamped; and making the sewing part of the sewing machine sew the base portion, the crests and part of the base in this order.

The combination of the above pleat forming-supplying apparatus and a sewing machine such as an electronic pleat sewing machine has the following effects (a), (b).

a) When pleats are formed-and supplied in the operation of sewing a curtain, since the input memory, the function of the output and the operation of a control unit are used to control the measurement of the space dimensions of each pleat set, the necessary dimensions of each pleat set and the like, errors are hardly caused in the respective dimensions and the finishing dimensions. Therefore, curtain quality is improved.

b) Since the input memory, the function of the output and the operation of the control unit are used, errors are hardly caused in the respective dimensions of crests and bases of each pleat and the pleat is also kept from falling down or getting out of shape. Therefore, curtain quality is improved.

However, the full width has to be measured in advance and input before it is fed in the case of such a conventional pleat forming-supplying apparatus.

Moreover, the pleating operation is performed while fabric is being manually held even after the fabric is set in the apparatus. In other words, the operation of clamping pleat length and folding the pleat while the end of the fabric is manually moved along guide rollers is performed. Further, the operation of inserting the fabric in the sewing machine and sewing the pleat and carrying out crest-check sewing (parallel line sewing) or inverted-T sewing is subsequently performed. Even after the thread is cut, the same clamping operation is needed while the fabric is manually held in preparation for the next pleating sewing.

At the time of normal and continuous operation, the sewing machine has to be stopped at the last pleat in order to input the length of the remaining fabric (including sorting long and short cases).

At the time of regulating operation, moreover, the length of the remaining fabric is first manually measured with an electronic measuring scale after the sewing machine is stopped with the length of the remaining three pleats left and then it is required to automatically regulate the remaining three pleats mutually in proportion to the remainder length.

SUMMARY OF THE INVENTION

An object of the present invention is therefore to provide an automatic curtain pleat sewing machine capable of contributing to improving productivity by automatically measuring the full width of fabric in a manner fit for manufacturing curtains on order and actually automating any kind of work other than setting fabric, inputting data and sewing the last pleat.

In order to accomplish the object above, a first aspect of the present invention provides an automatic curtain pleat sewing apparatus comprises a sewing machine having sewing needles, a pleat forming-supplying unit having forepart holding means for holding the leading end portion of a curtain fabric and the remainder thereof, pleat folding means for pleating the curtain fabric thus held by the forepart holding means, pleat portion supply means for integrally rotating the forepart holding means, the pleat folding means operating so as to insert the pleated portion of the curtain fabric in the sewing part of the sewing machine, a rear-end holding unit having a clamp member and a slide member capable of moving the rear end portion of the curtain fabric forward and backward while holding the rear end portion thereof, and a full-width measuring unit capable of measuring the full width of the curtain fabric when the rear-end holding unit moves backward.

In this case, for example, the pleat forming-supplying unit is incorporated with the body of the sewing machine, whereas the rear-end holding unit and the full-width measuring unit are incorporated with the fabric stage which mounts the curtain fabric that has been spread out.

The fabric stage has a length of over 2 m and is coupled to the body side of the sewing machine. The space portion for exposing the forepart holding means, the pleat folding means and the pleat portion supply means of the pleat forming-supplying unit is formed on the machine body side of the fabric stage.

The front end portion of the curtain fabric is held by the forepart holding means of the pleat forming-supplying unit, whereas the rear end portion thereof is held and set by the rear-end holding unit.

The rear-end holding unit holding the rear end portion of the curtain fabric moves the fabric stage backward to have the curtain fabric lightly stretched with respect to the forepart holding means on the front end side of the curtain fabric. In this state, the full width of the curtain fabric is measured by the full-width measuring unit.

Incidentally, the formation of the pleated portion and the insertion thereof in the sewing part of the sewing machine are carried out by the pleat forming-supplying unit successively in accordance with the number of pleats and in the meantime, the operation of moving the rear-end holding unit is performed successively and interlockingly.

Since the automatic curtain pleat sewing apparatus is provided with the sewing machine, the pleat forming-supplying unit having forepart holding means for holding the leading end portion of the curtain fabric and the remainder thereof, the pleat folding means for pleating the curtain fabric thus held by the forepart holding means, and the pleat portion supply means for integrally rotating the forepart holding means and the pleat folding means so as to insert the pleated portion of the curtain fabric in the sewing part of the sewing machine, and further the rear-end holding unit capable of moving the rear end portion of the curtain fabric forward and backward while holding the rear end portion thereof, and the full-width measuring unit capable of measuring the full width of the curtain fabric when the rear-end holding unit moves backward, the full width of the curtain fabric can be measured by the full-width measuring unit on the basis of the backward movement of the rear-end holding unit holding the rear end portion of the curtain fabric.

As the full width is automatically measurable, any kind of work can be automated other than setting fabric, inputting data and sewing the last pleat.

Therefore, the automatic curtain pleat sewing machine is particularly fit for the production of curtains on order and productivity is improvable.

According to a second aspect of the present invention, there is provided the automatic curtain pleat sewing apparatus according to the first aspect which is provided with the control unit for automatically setting input data such as the finishing width, the number of pleats, the selvedge width and the number of crests; and the corresponding dimensions including the hook interval, the pleat length and the height of the crest in the pleating portion to be formed by the pleat forming-supplying unit on the basis of the full width measured by the full-width measuring unit.

In addition to the arrangement of the first aspect, the automatic curtain pleat sewing machine is provided with the control unit for automatically setting the corresponding dimensions of the pleating portion formed by the pleat forming-supplying unit on the basis of the full width measured by the full-width measuring unit, whereby the corresponding dimensions of the pleating portion can automatically be set by means of the control unit on the basis of the full width measured by the full-width measuring unit.

According to a third aspect of the present invention, there is provided the automatic curtain pleat sewing apparatus according to either first or second aspect is such that the rear-end holding unit moves forward to, for instance, the extent defined by the sum of (the hook interval)+(1-tack pleat length)+(the distance covered by the hold-down means of the sewing machine which moves to the origin)+(proper allowance) so as to loosely stretch the curtain fabric before the pleated portion of the curtain fabric is formed by the pleat forming-supplying unit.

In addition to the arrangement according to the first or second aspects, the rear-end holding unit of the automatic curtain pleat sewing machine moves forward so as to loosely stretch the curtain fabric before the pleated portion of the curtain fabric is formed by the pleat forming-supplying unit, whereby the formation of the pleating portion is smoothly made since the rear-end holding unit holding the rear end portion of the curtain fabric moves forward so as to loosely stretch the curtain fabric when the pleating portion is formed.

According to a fourth aspect of the present invention, the automatic curtain pleat sewing apparatus according to one of first to third aspects wherein the rear-end holding unit moves backward in order to accomplish the following purposes, for example, the purpose of lightly stretching the fabric so as to pass the fabric between the front and rear clamp plates and the upper and lower clamp plates; the purpose of aligning the upper end of the fabric to as to have the intermediate portion of the fabric held by the intermediate portion adjusting unit; and the purpose of obtaining the hook interval and the 1-tack pleat length with accuracy by linearly stretching the fabric because accurate dimensions are not attained if the fabric is loosely stretched.

In addition to the arrangement according to one of the first to third aspects, since the rear-end holding unit of the automatic curtain pleat sewing machine moves backward after the termination of the sewing operation performed by the sewing machine, the curtain fabric has a certain degree of stiffness, which results in making the clamp plates recurrent without trouble, thus obviating errors in hook interval dimensions.

According to a fifth aspect of the present invention, there is provided the automatic curtain pleat sewing apparatus according to one of the first to fourth aspects wherein the intermediate portion adjusting unit having the clamp and slide members for holding the intermediate portion of the curtain fabric and making adjustment is disposed so as to move the curtain fabric in a direction perpendicular to the fabric-feeding direction when the curtain fabric is fed in preparation for the formation of the next pleated portion thereof.

In addition to the arrangement according to one of aforementioned aspects, since the intermediate portion adjusting unit of the automatic curtain pleat sewing machine is used for holding the intermediate portion of the curtain fabric and making adjustment so as to move the curtain fabric in a direction perpendicular to the fabric-feeding direction when the curtain fabric is fed in preparation for the formation of the next pleated portion thereof, pleat-sewing quality is improved as any difference in level is prevented from occurring on the edge face of the pleat folding portion by holding the intermediate portion of the curtain fabric and making adjustment so as to move the curtain fabric in a direction perpendicular to the fabric-feeding direction when the curtain fabric is fed in preparation for the formation of the next pleated portion thereof.

According to the sixth aspect, there is provided the automatic curtain pleat sewing apparatus according to one of the first to fifth aspects is provided with the fabric feed guide unit which is located downward along the fabric stage, for example, when the full width of the curtain fabric is measured and which moves upward and moves forward and backward in synchronization with the rear-end holding unit during the sewing operation, which fabric feed guide unit comprises, for example, a guide case, a belt conveyer and a motor.

In addition to the arrangement according to the aforementioned aspects, since the fabric feed guide unit of the automatic curtain pleat sewing machine is located downward when the full width of the curtain fabric is measured, moves upward and moves forward and backward in synchronization with the rear-end holding unit during the sewing operation, the full width of the fabric is smoothly measured as the fabric feed guide unit stays downward when the full width is measured, that is, the fabric is prevented from becoming twined around the fabric feed guide unit and the fabric is extended as it is moved backward by the rear-end holding unit.

During the sewing operation, further, the fabric is prevented from hanging down to a considerable degree as the fabric feed guide unit moves upward, whereby the adjustment of the movement of the intermediate portion holding member and the time required therefor are minimized with the effect of increasing efficiency.

During the sewing operation when the fabric feed guide unit is moved upward, the weight of the fabric applied to the rear-end holding member is reduced as the fabric feed guide unit moves forward and backward in synchronization with the rear-end holding unit.

BRIEF DESCRIPTION OF THE DRAWINGS

FIG. 9(*b*) to a two-crest case;

FIG. 15(*b*) a plan view showing cases of pleat and inverted-T sewing;

FIGS. 18(*a*) to 18(*e*) show curtain terms: 18(*a*) is an upper elevational view of fabric; 18(*b*) an upper elevational view of a sewn pleat; 18(*c*) a diagram showing a difference in the number of crests; 18(*d*) a diagram showing an edge face indicative of crest height; and 18(*e*) a diagram showing an edge face indicative of base depth.

DETAILED DESCRIPTION OF THE PREFERRED EMBODIMENTS

A description will be given of an automatic curtain pleat sewing machine according to the present invention with reference to FIGS. 1 through 17 inclusive.

Figure 1:
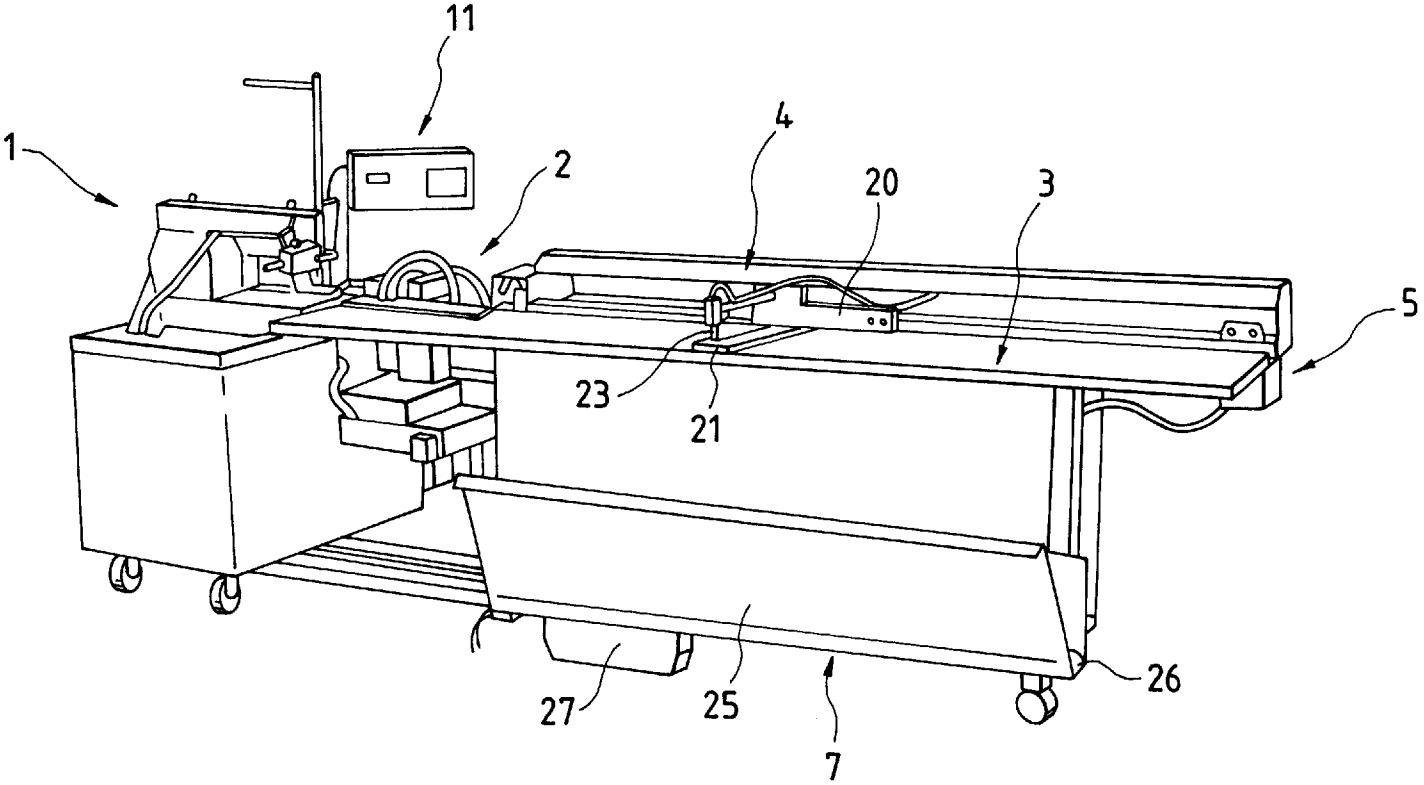
FIG. 1 is a perspective view of the external appearance of an exemplary automatic curtain pleat sewing machine as an application of the present invention.
Figure 2:
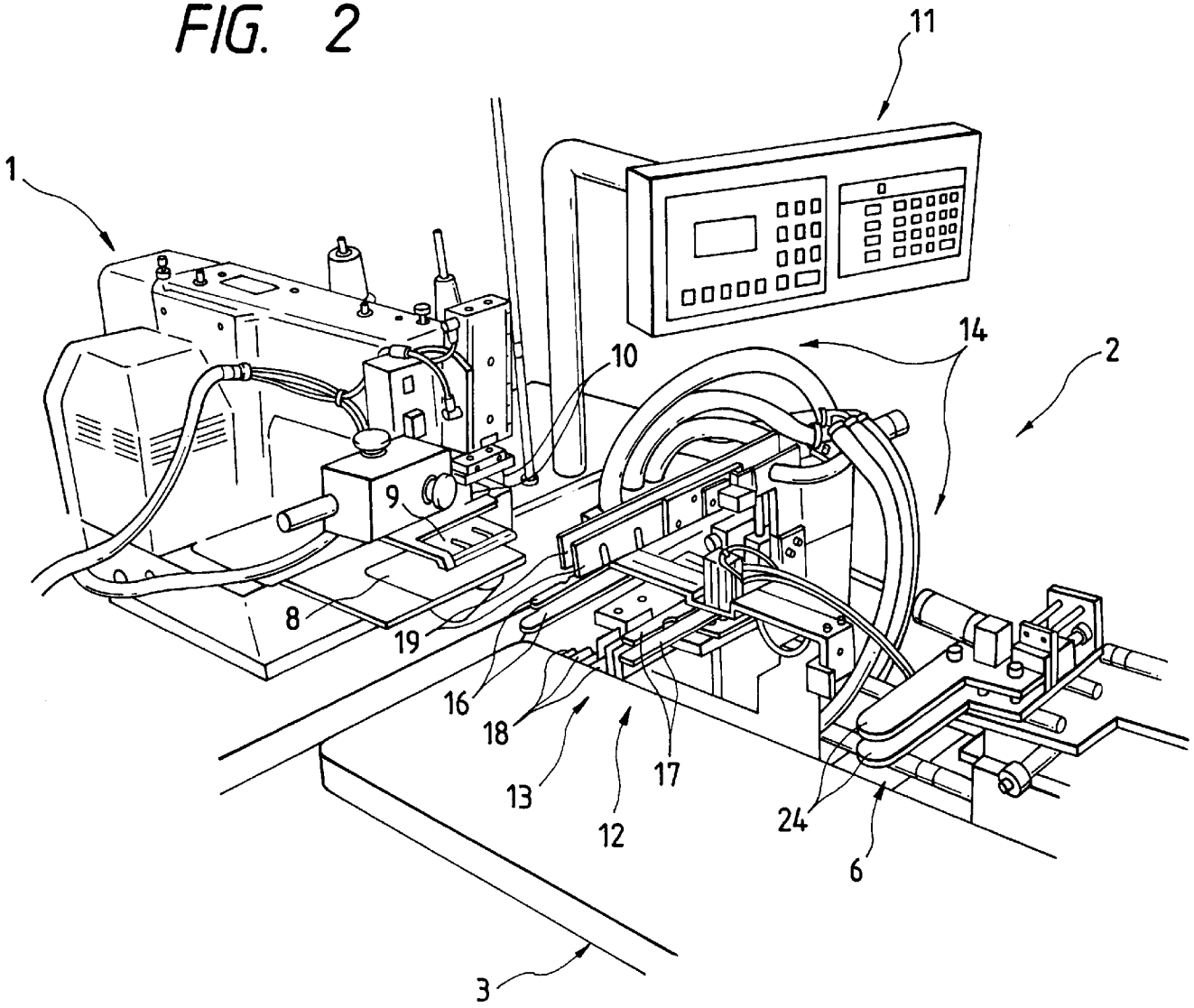
FIG. 2 is an enlarged perspective view of a sewing unit together with a pleat folding unit and a forepart holding unit in the automatic curtain pleat sewing machine.

FIG. 1 is a perspective view of the external appearance of an exemplary automatic curtain pleat sewing machine as an application of the present invention; FIG. 2 an enlarged perspective view of a sewing unit together with a pleat folding unit and a forepart holding unit in the automatic curtain pleat sewing machine; and FIG. 3 an enlarged perspective view of a fabric stage, rear-intermediate portion holding units and a guide unit in the automatic curtain pleat sewing machine.

Figure 4:
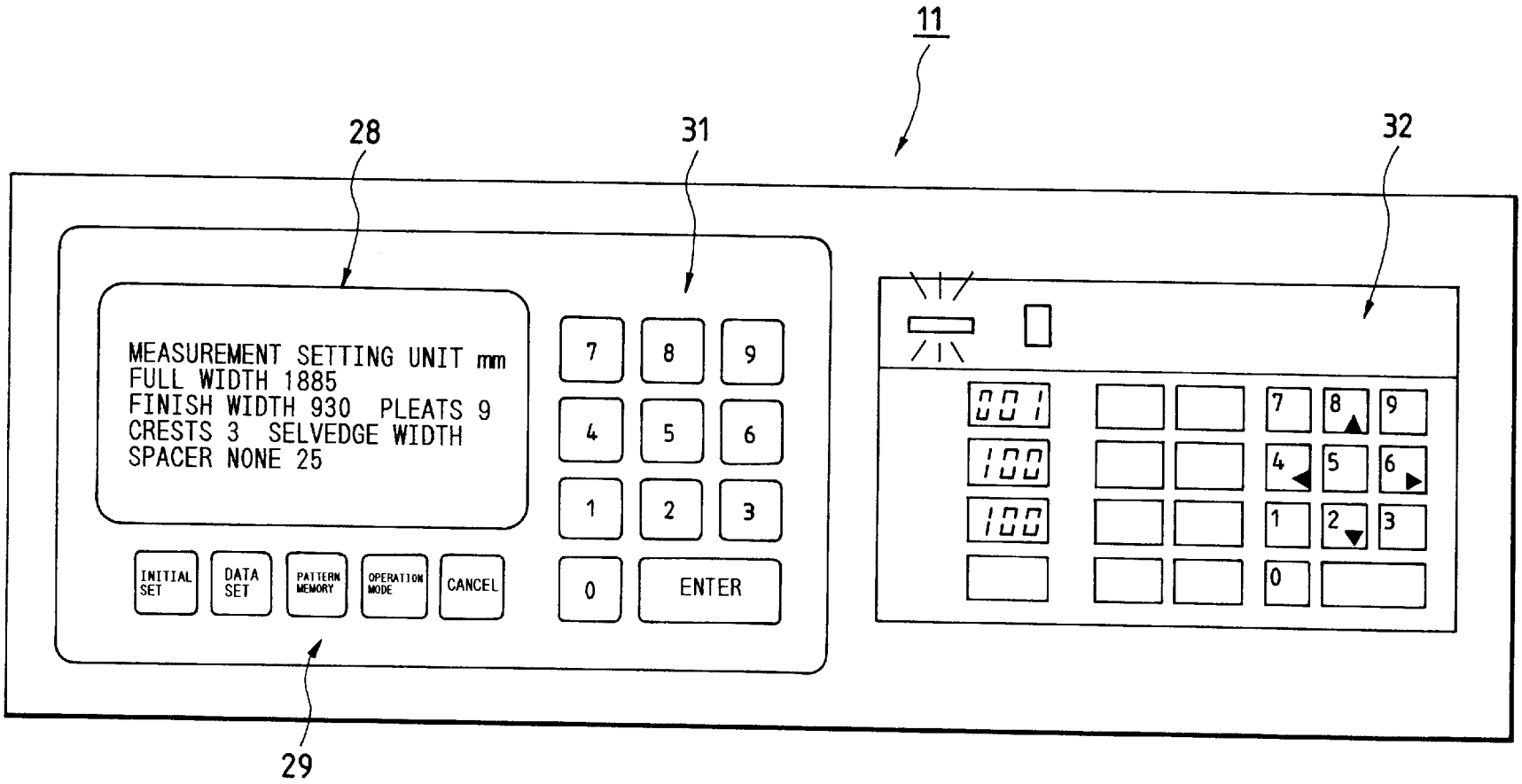
FIG. 4 is an enlarged elevational view of a control panel of the automatic curtain pleat sewing machine of FIG. 1.

Further, FIG. 4 is an enlarged elevational view of a control panel of the automatic curtain pleat sewlng machine of FIG. 1.

Figure 5:
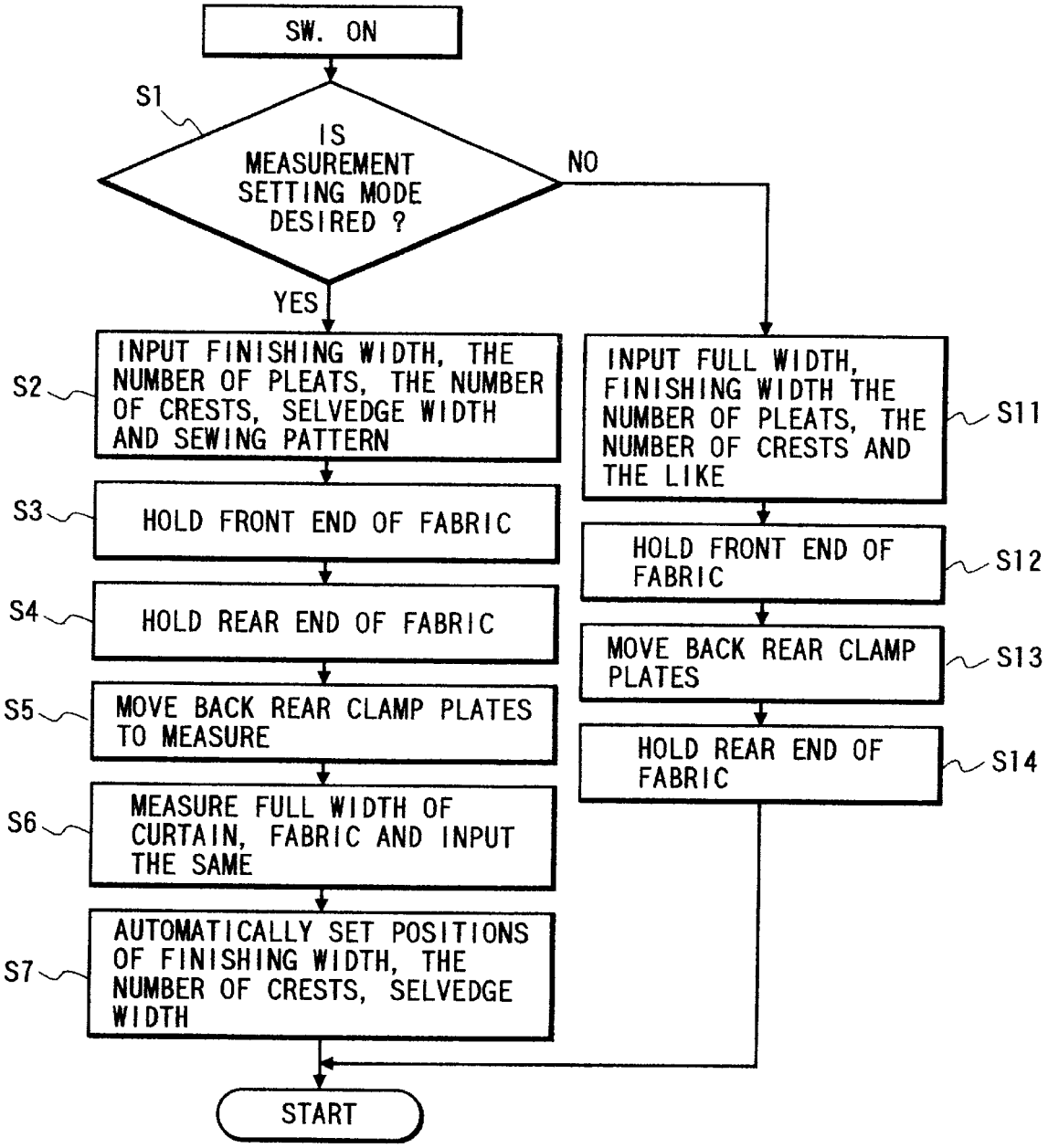
FIG. 5 is a flowchart showing an example of automatic control exerted by the automatic curtain pleat sewing machine according to an embodiment of the invention.
Figure 6:
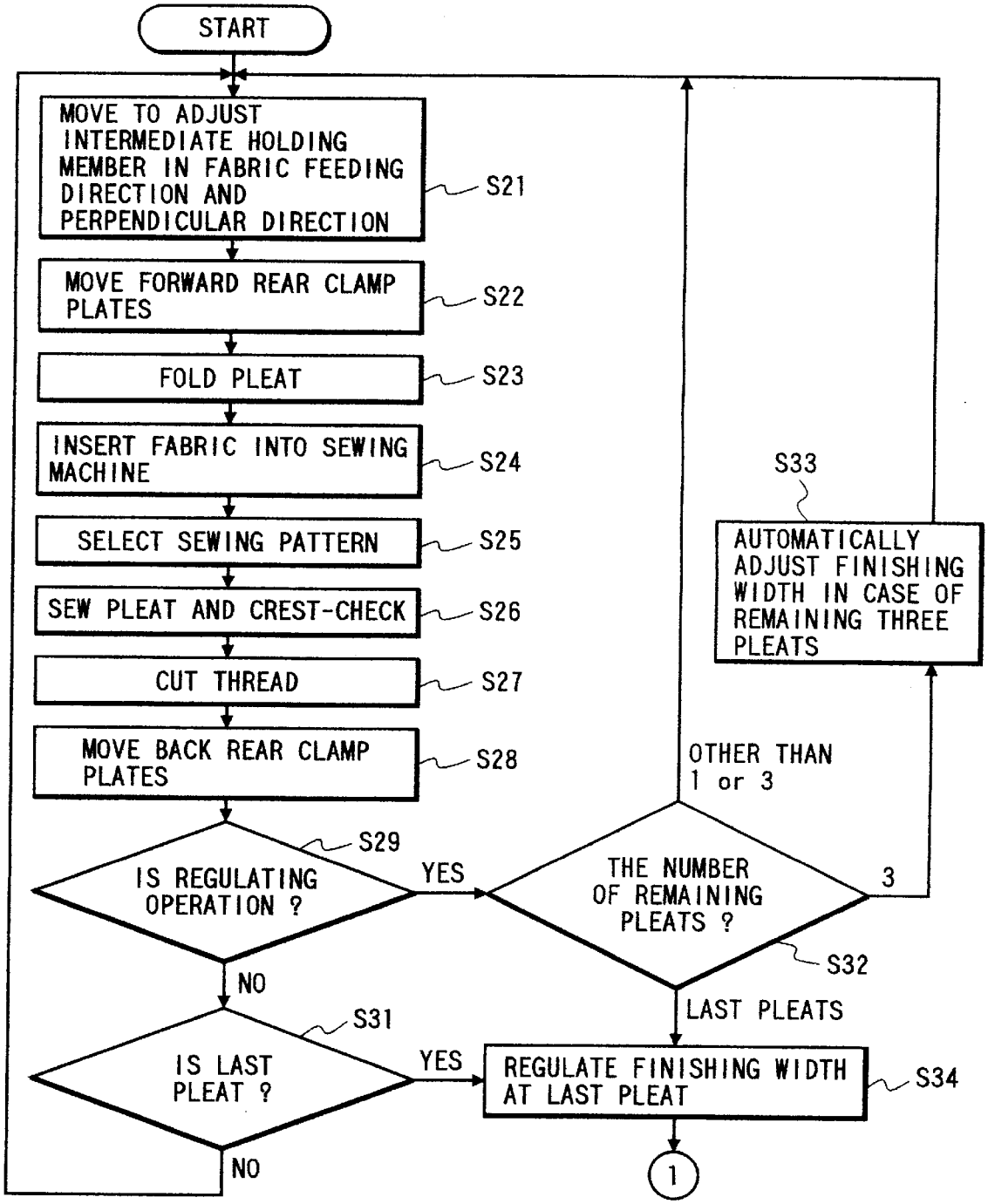
FIG. 6 is a flowchart showing a series of processes which follow those shown in FIG. 5.
Figure 7:
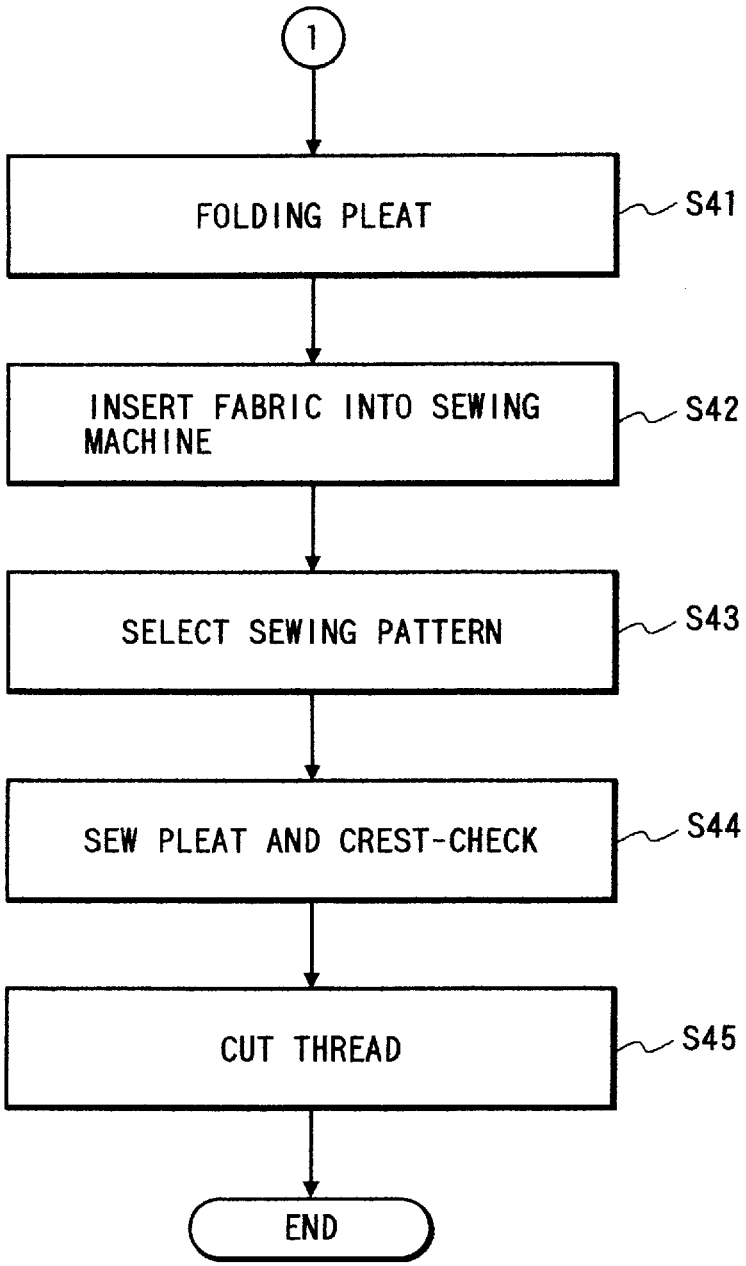
FIG. 7 is a flowchart showing a series of processes which follow those shown in FIG. 6.

Further, FIGS. 5 through 7 are flowcharts showing exemplary automatic control processes to be performed by the automatic curtain pleat sewing machine according to this embodiment of the invention.

Further, FIGS. 8 through 17 show sewing procedures ranging from a state in which the forepart of fabric is clamped up to a stage where the last pleat is formed according to this embodiment of the invention.

Figure 3:
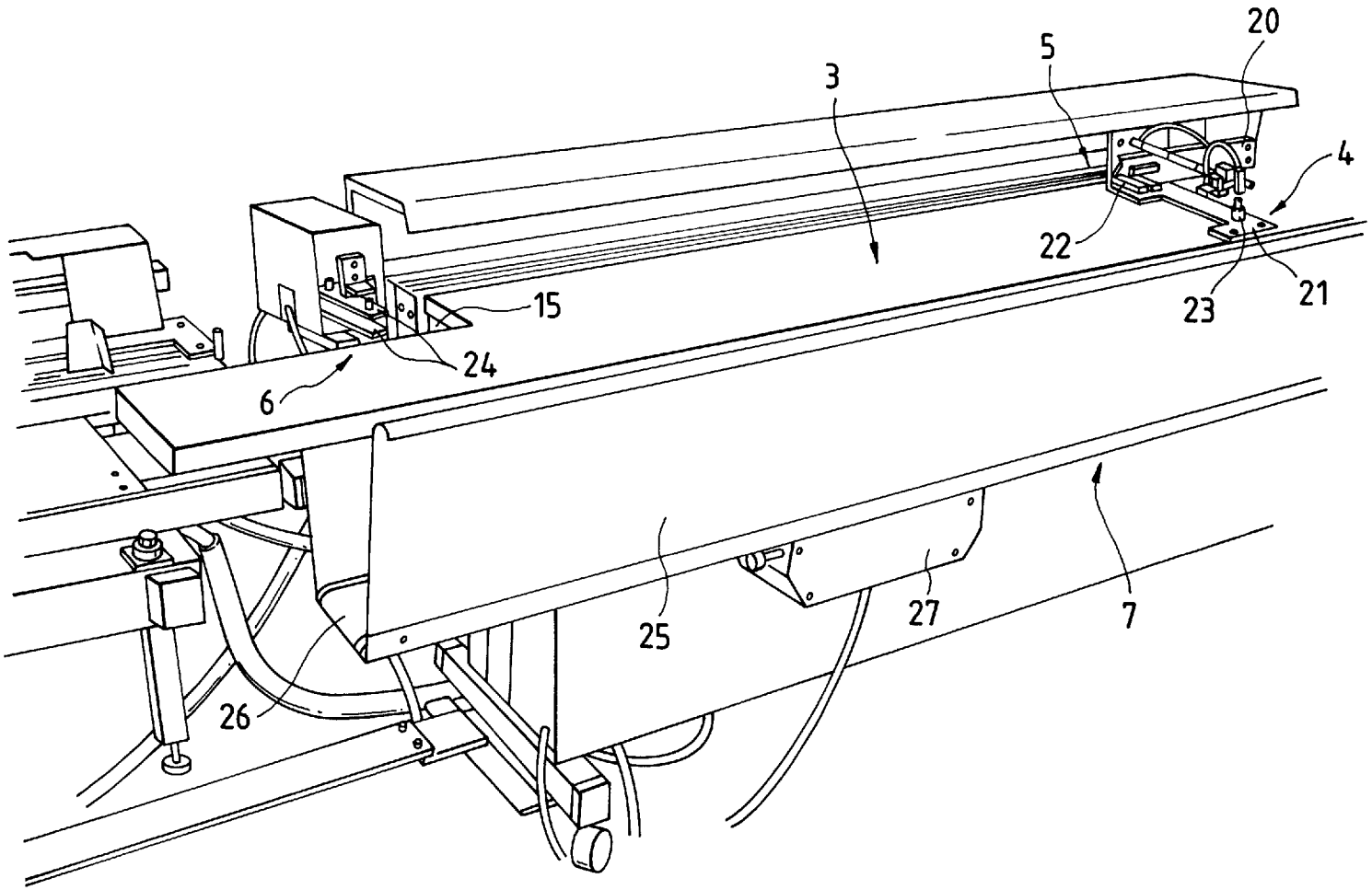
FIG. 3 is an enlarged perspective view of a fabric stage, rear-intermediate portion holding units and a guide unit in the automatic curtain pleat sewing machine of FIG. 1.

In FIGS. 1 to 3 first, reference numeral 1 denotes a sewing machine; 2, a pleat forming-supplying unit; 3, a fabric table; 4, a rear-end holding unit; 5, a full-width measuring unit; 6, an intermediate portion adjusting unit; 7, a fabric feed guide unit; 8, a throat plate; 9, a presser foot; 10, a needle; 11, a control panel; 12, a forepart holding means; 13, a pleat folding means; 14, a pleat portion supply means; 15, a space portion: 16, 16, front clamp plates; 17, 17, rear clamp plates; 18, 18, 18, lower folding plates; 19, 19, upper folding plates; 20, a slide plate; 21, a lower clamp plate; 22, an upper clamp plate; 23, an auxiliary fabric hold-down means; 24, a clamp plate; 25, a guide case; 26, a belt conveyer; and 27, a motor.

More specifically, the automatic curtain pleat sewing machine comprises, as shown in the drawings, the sewing machine 1, the pleat forming-supplying unit 2, the fabric table 3, the rear-end holding unit 4, the full-width measuring unit 5, the intermediate portion adjusting unit 6, and the fabric feed guide unit 7.

As shown in FIG. 2, the sewing machine 1 is provided with the throat plate 8 on a bed, the fabric hold-down means 9 which is disposed above the throat plate 8 and made movable upward and downward, and a pair of needle 10, 10 disposed further above the fabric hold-down means 9. Furthermore, the control panel 11 is provided in the proximity of the body of the sewing machine 1.

The pleat forming-supplying unit 2 is fitted to the sewing machine 1 in a manner adjacent to the body thereof. The pleat forming-supplying unit 2 is provided with the forepart holding means 12 for holding curtain fabric C (see FIG. 8 and thereafter) by clamping both sides of a pleat portion in the forepart of the curtain fabric C, the pleat folding means 13 for forming a desired pleat over the pleat length of the curtain fabric C held by the forepart holding means 12, and the pleat portion supply means 14 for forcing the pleat portion formed by the pleat folding means 13 into the sewing part (between the throat plate 8 and the fabric hold-down means 9) of the sewing machine 1.

The fabric table 3 is in the form of a table about 3 m to 4 m in lateral length and integrally set adjacent to the body 1 of the sewing machine 1.

The aforementioned pleat forming-supplying unit 2, that is, the combination of the forepart holding means 12, the pleat folding means 13 and the pleat portion supply means 14, and the intermediate portion adjusting unit 6 are disposed in the space portion 15 formed in the fabric table 3.

The forepart holding means 12 is used to hold the forepart side of the fabric and as shown in FIG. 2, provided with a pair of upper and lower front clamp plates 16, 16 for holding the front end portion of the fabric at the beginning, and a pair of upper and lower rear clamp plates 17, 17 for holding a portion which is separated by a predetermined dimension of the pleat length from the holding portion. These front clamp plates 16, 16 and the rear clamp plates 17, 17 are used to hold the fabric horizontally.

The pleat folding means 13 is positioned between the front clamp plates 16, 16 and the rear clamp plates 17, 17 of the forepart holding means 12 and has the three lower folding plates 18, 18, 18 and the two upper folding plates 19, 19. These lower folding plates 18, 18, 18 and the upper folding plates 19, 19 are made movable upward and downward and besides alternately arranged in the longitudinal direction.

With respect to the three lower folding plates 18, 18, 18, the central folding plate is made movable upward and downward and when the number of crests displayed on a liquid crystal display 28 of FIG. 4 is 2, it moves down so that two crests can be formed. Whereas when the number of crests thereon is 3, it moves upward so that three crests can be formed. Moreover, the two folding plates 19, 19 are also adapted so that they become stacked up.

The pleat portion supply means 14 is provided with a rotatable rotary plate incorporating the front clamp plates 16, 16 and the rear clamp plates 17, 17 of the forepart holding means 12 and their drive unit, and the lower folding plates 18, 18, 18 and the upper folding plates 19, 19 of the pleat folding means 13 and their drive unit. Moreover, the pleat portion supply means 14 is also provided with a slide member incorporating the rotary plate and drive unit.

The rear-end holding unit 4 is used to hold the rear end portion of the fabric and as shown in FIGS. I and 3, including: the slide plate 20 which is movable in parallel to the fabric table 3; the lower clamp plate 21 fixed to the slide plate 20; the upper clamp plate 22 which is incorporated with the slide plate 20 in a manner movable upward and downward; the auxiliary fabric hold-down means 23 installed above the front end portion of the lower clamp plate 21; and a drive unit. In addition, the rear-end holding unit 4 is also equipped with a sensor for deciding whether or not a cylinder has moved down when this side of the fabric is clamped by moving down the cylinder using a switch.

The slide plate 20 keeps clamping the rear side of the fabric so as to hold the pleat portion until it reaches the last pleat but one with the lower clamp plate 21, the upper clamp plate 22 and the auxiliary fabric hold-down means 23 and releases the fabric at the position of the last pleat before moving back.

The slide plate 20 roughly stops at the following three positions:

(1) When the full width of the fabric is situated within the range of the stage, the slide plate 20 stops at the first point wherein the fabric is clamped, that is, a point A;

(2) When the full width of the fabric remains outside the stage, the slide plate stops at a rear-end point B; and (3) When the remainder comes to stay within the range of the stage as the sewing operation proceeds although the full width of the fabric remains outside the stage, the slide plate stops at the end of the remainder of the fabric.

The full-width measuring unit 5 is incorporated with the drive unit of the slide plate 20 of the rear-end holding unit 4 and capable of measuring the full width of the curtain fabric on the basis of the movement of the slide plate 20.

More specifically, a servo motor is installed in the rear end portion (in the direction of the inner part on the right-hand side) of the fabric table 3. In other words, the servo motor is installed in such a way that it is coupled to a slide rail so as to move longitudinally and linearly along a line on which the rear-end holding unit 4 is located. The servo motor shaft is fitted with a gear and a timing belt runs vertically on the inner part side of the slide rail with respect to the gear. The timing belt and a slide base on the slide rail communicate with each other and furthermore the slide plate 20 is coupled thereto.

A base-point sensor is fitted to the inner part of the slide rail, so that the rear-end holding unit 4 may always stop at the same position when the fabric is set initially. Moreover, a sensor is placed in three places; namely, a forward marginal point, a backward movement marginal point in addition to the inner part of the slide rail.

In other words, a light receiving unit of the sensor is furnished in three places in parallel to the slide rail in the inner part of the rail and a light emitting sensor fitted to the slide plate 20 is made movable forward and backward. In this case, these sensors are called a light receiving sensor A (at the point where clamping is made initially), a light receiving sensor B (at the rear-end point) and a light receiving sensor C (at the forward marginal point), respectively.

A description will subsequently be given of a measuring method to be implemented by the full-width measuring unit 5.

First, the front end of the fabric is clamped between the upper and lower plates of the front clamp plate 16. A computer recognizes the length up to the set position (base point) of the rear-end holding unit 4 since it has already recognized the present position of the front clamp plate 18.

Further, the rear-end holding unit 4 follows the steps of clipping the end of the fabric, linearly moving back along the slide rail by means of the servo motor operates, picking up a pulse signal until the fabric is stopped after being stretched up to its limit, measuring the length of the fabric and making the liquid crystal display 28 of the control panel 11 display the number as the full width (see FIG. 4)

The intermediate portion adjusting unit 6, which is disposed in the space portion 15 formed in the fabric table 3, includes the pair of upper and lower clamp plates 24, 24 as intermediate holding members at the end of the space portion 15 of the fabric table 3 in the position slightly separated backward from the pleat forming-supplying unit 2, a slide mechanism for making the clamp plates 24, 24 slide in a direction perpendicular to the fabric-feeding direction, and their drive unit.

Thus the curtain fabric is kept horizontal by the clamp plates 24, 24 situated in the intermediate portion, the front clamp plates 16, 16 on the aforementioned front side, the rear clamp plates 17, 17, the lower clamp plate 21 and the upper clamp plate 22 in the rear end portion.

Since the intermediate portion adjusting unit 6 is always regulating the fabric up to the remaining third pleat when the operation of the sewing machine is started with the fabric set on the fabric table, the clamp plate 24 is regulated so that it is turned in a direction perpendicular to the fabric-feeding direction and toward the remaining third pleat, and positioned in the space portion 15 before being moved back to the right-hand side in a direction perpendicular to the fabric-feeding direction. Further, the intermediate portion adjusting unit 6 makes room for the slide plate 20 holding the rear end of the fabric so that it may move forward further.

The fabric feed guide unit 7 is provided on this side of the fabric table 3.

As shown in FIGS. 1 and 3, the fabric feed guide unit 7 is provided with the guide case 25 which is movable upward and downward and capable of containing curtain fabric handing down from the fabric table 3 to this side, its drive unit, the belt conveyer 26 on the base of the guide case 25. When the motor is operated, the fabric on the belt conveyer 26 can be fed in response to the feeding of the rear end portion of the fabric clamped among the slide plate 20, the clamp plate 22 and the auxiliary fabric hold-down means 23 of the rear-end holding unit 4.

As shown in an enlarged figure, the control panel 11 is provided with the liquid crystal display 28, an operating key board 29, a ten key pad 31 and a keyboard 32 for use in operating the sewing machine body.

In this case, various items of dimensions in a measurement setting mode are displayed on the liquid crystal display 28, in which mode the full width of curtain fabric is automatically measured. In this example of display, there are shown finishing width=930 mm, the number of pleats=9, the number of crests=3 and selvedge width=25 mm when the full width of curtain fabric is 1,885 mm without a spacer.

In addition to the measuring mode, there are a simplified mode wherein data is input when only the number of pleats is indistinct and a pattern No. setting mode wherein stored data on the dimensions for frequent use is called up and so forth. The spacer is used to obtain a beautiful finish with three crests by using thick fabric such as a drape and therefore not required for lace, printed fabric and the like.

A description will subsequently be given of work and operation using the automatic curtain pleat sewing machine thus constructed by reference to flowcharts of FIGS. 5 through 7 in this order. Incidentally, a control unit such as a microcomputer (not shown) is employed for controlling the operation above.

First, one of the measurement setting, normal, simplified and pattern setting modes is selected in order to set a proper mode to the setting portion of the liquid crystal display 28 of the control panel 11 of FIG. 4 after an electrical switch is turned ON.

At STEP S1, a decision is made first on whether the measurement setting mode is desired and when it is the measurement setting mode, data necessary for setting the desired mode is fed at STEP S2. In other words, the control panel 11 of FIG. 4 is used to input the data required for making a pleated curtain on order such as finishing width, the number of pleats, the number of crests, selvedge width, a sewing pattern and the like.

The input operation at STEP S2 may be performed at STEP S6 after the automatic measurement of the full width is made and input.

Subsequently, curtain fabric is set.

Figure 8:
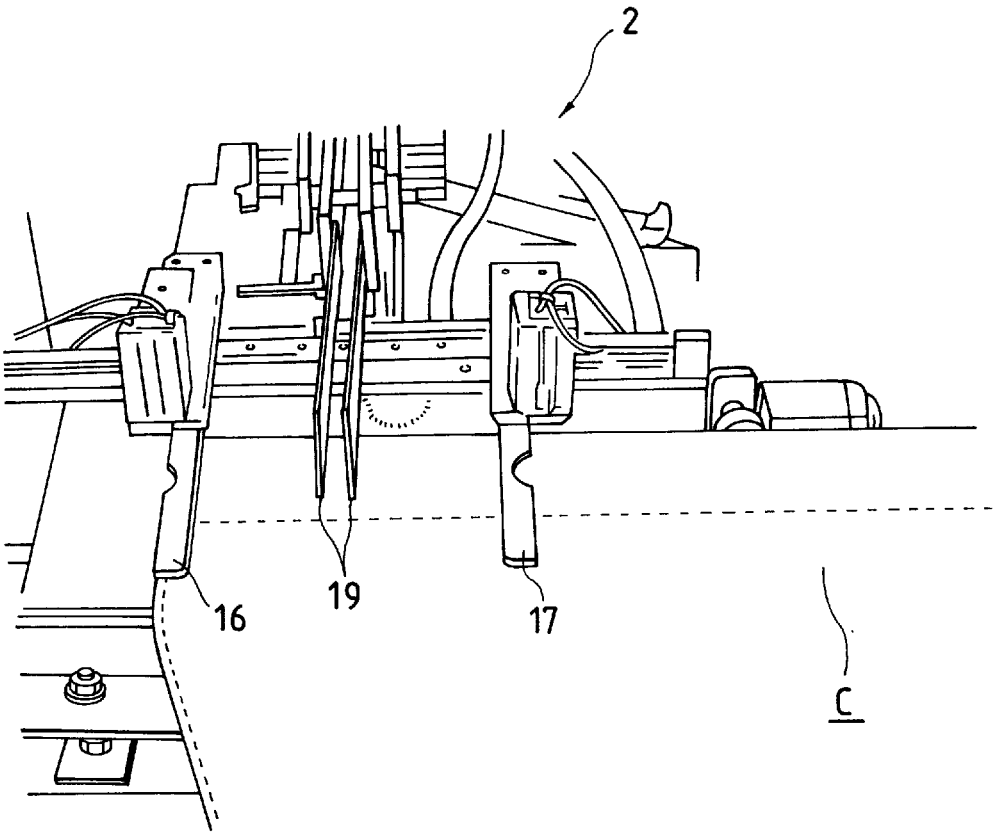
FIG. 8 is a perspective view showing a state in which the fabric is clamped by the front clamp plates according to an embodiment of the invention.

More specifically, the front end portion of the curtain fabric C is held by the front clamp plates 16 at the next STEP S3 as shown in FIG. 8, whereas the rear end portion of the fabric is held by the lower and upper clamp plates 21, 22 at STEP S4.

The clamp setting like this is manually carried out by a worker.

In this case, the fabric is arranged so that it has been passed between the rear clamp plates 17, 17 in the forepart and between the clamp plates 24, 24 in the intermediate portion when the curtain fabric C is set and when its front and rear end portions are clamped.

After the front and rear portions of the curtain fabric C have thus been clamped, the slide plate 20 having the lower clamp plate 21 and the upper clamp plate 22 which are used to hold the rear end portion of the fabric is moved back at the next STEP S5.

Then the curtain fabric C becomes stretched horizontally between the front clamp plates 16 in the front end portion and between the upper and lower clamp plates 21, 22 in the rear portion. Further, the full width of the fabric is measured by the full-width measuring unit and the measured numerical value is input at the next STEP S6.

After the above-described necessary data including the full-width measurement has been input and set, various kinds of automatic setting items such as a hook interval, selvedge width, crest height, the switching of the number of crests from two to three and vice versa are set for registering purposes.

In other words, the automatic setting of the following items is based on the decisions made on the hook interval between the hold-down for sewing and the front clamp plates 16, one tack length between the rear clamp plates 17 with respect to the front clamp plates 16, an ascending degree for obtaining the height of a pleat crest at the lower folding plates 18, 18, 18, and the number of lower and upper folding plates 18, 18, 18 and 19, 19.

When a start switch is turned ON, adjustment is made so as to move the curtain fabric C in a direction perpendicular to the fabric-feeding direction at STEP S21 in such a state that the intermediate portion of the curtain fabric C has been clamped by the clamp plates 24, 24.

Figure 10:
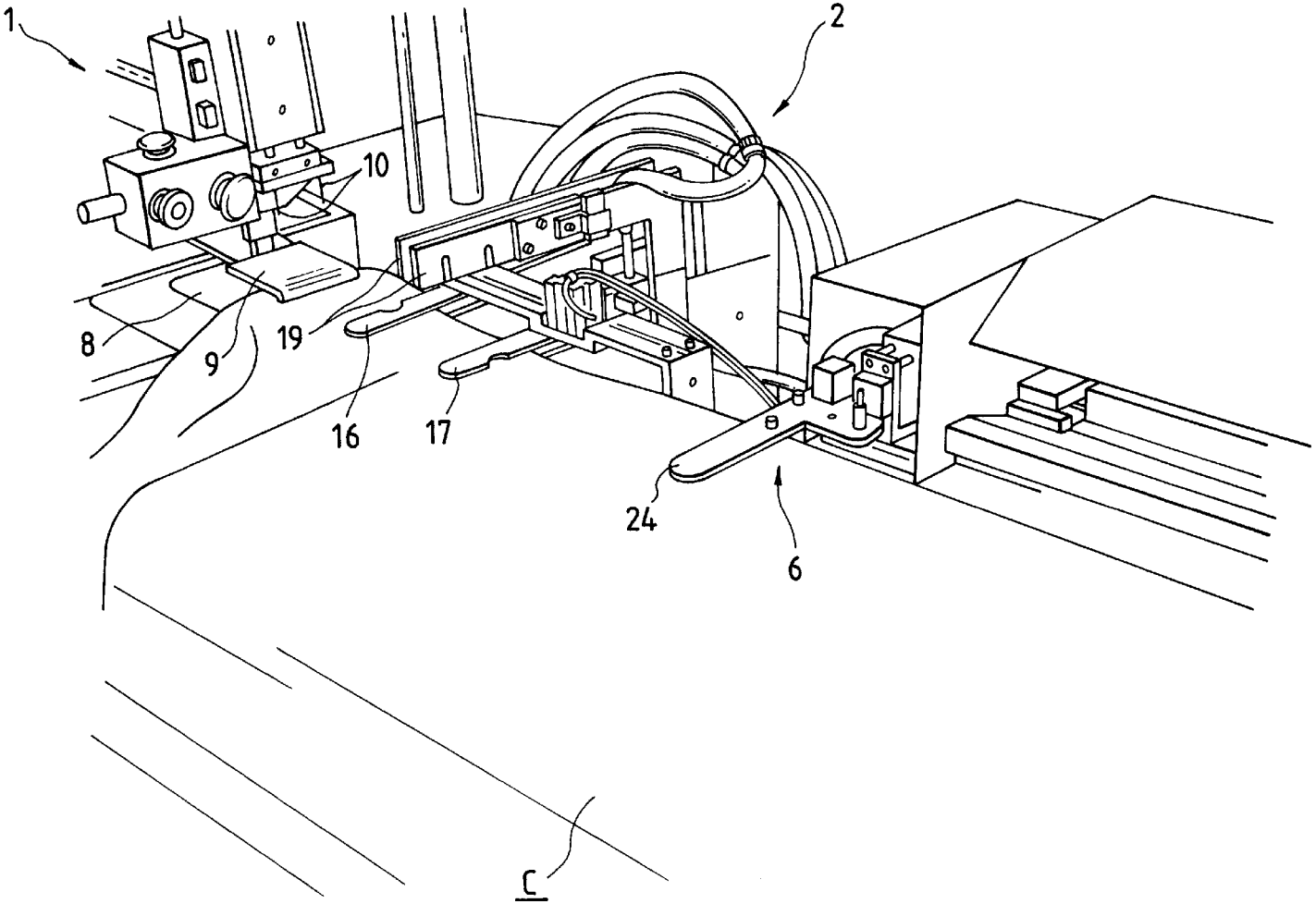
FIG. 10 is a perspective view in reference to a state following what is shown in FIGS. 9(*a*) and 9(*b*) wherein surface adjustment is made in the intermediate portion of fabric.

As shown in FIG. 10, the curtain fabric C whose forepart has been clamped by the front clamp plaLes 16, 16 is clamped by the clamp plates 24, 24 so that the surface of its upper end portion is made flat; the operation of making the surface flat is controlled by an optical detecting unit.

Then the fabric is held by the rear clamp plates 17, 17 and then released from being clamped by the clamp plates 24, 24. At this time, the curtain fabric C is retained by the clamp plates 17 at the position separated from the front clamp plates 16 holding the front end portion thereof by a predetermined dimension of the pleat length.

The operation of regulating the surface of the upper end portion of the fabric is followed by that of moving forward the upper and lower clamp plates 21, 22 holding the rear end portion of the fabric at the next STEP S22. Then a pleating command is issued at the next STEP S23.

In other words, the upper and lower clamp plates 21, 22 which keep holding the rear end portion of the fabric are moved forward beforehand at STEP S22 in order to pull the fabric subjected to pleating at the following STEP S23 and to insert it in the sewing machine 1 at STEP S24 after the pleating operation.

Incidentally, the forward movement of the upper and lower clamp plates 21, 22 has been predetermined to a quantity (e.g., 65 mm) resulting from adding a margin to a fabric-to-machine inserting dimension (e.g., no-load feeding 50 mm up to the original sewing point of the fabric hold-down means 9) in addition to the hook interval and the pleat length.

The rear-end holding unit may be moved forward and backward in a manner interlocking with the longitudinal movement of the folding unit with a predetermined marginal space so as to have the fabric slightly strained.

The pleating operation at STEP S23 is performed when the lower folding plates 18, 18, 18 are moved up from below with respect to the fabric and when the upper folding plates 19, 19 are moved down from above therewith. At this time, the front clamp plates 16 are moved back and the rear clamp plates 17 are moved forth, so that these plates are moved synchronously.

Figure 9A:
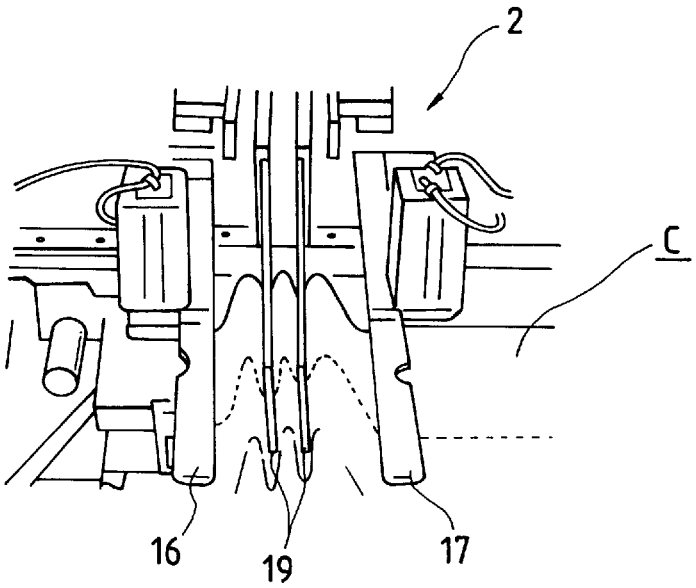
FIGS. 9(*a*) and 9(*b*) show an in-fabric pleat folding process which follows FIG. 8. More specifically, FIG. 9(*a*) is a perspective view in reference to a three-crest case.
Figure 9B:
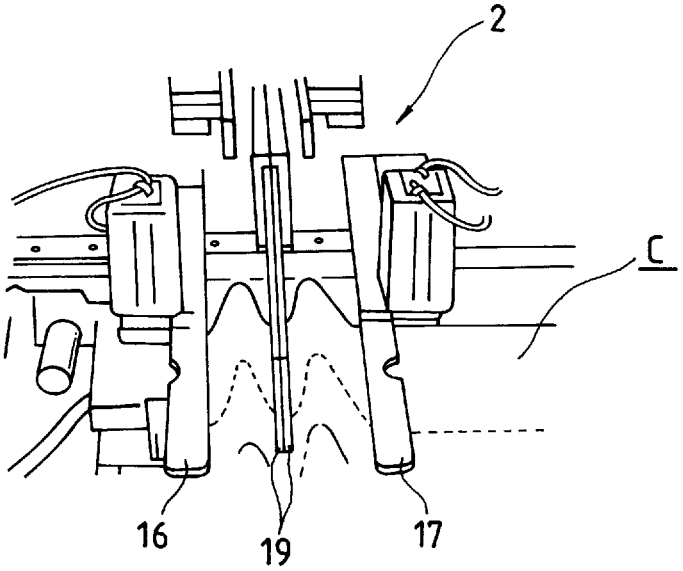

In the case of three crests, the three pieces of lower folding plates 18, 18, 18 are moved up from below with respect to the fabric, whereas the two pieces of upper folding plates 19, 19 are moved down from above therewith, whereby three crests are formed as shown in FIG. 9(*a*).

In the case of two crests, further, the one central folding plate is moved down from below and the two pieces of folding plates 18, 18 on both sides are moved up with respect to the fabric, whereas the two pieces of folding plates which are stacked together and serve as one piece of upper folding plates 19 (19) are moved from above, whereby two crests are formed as shown in FIG. 9(*b*).

Thus a predetermined pleating operation (with three crests that have been set as shown in FIG. 4) is performed and the curtain fabric C is inserted in the sewing machine 1 at the next STEP S24.

Figure 11:
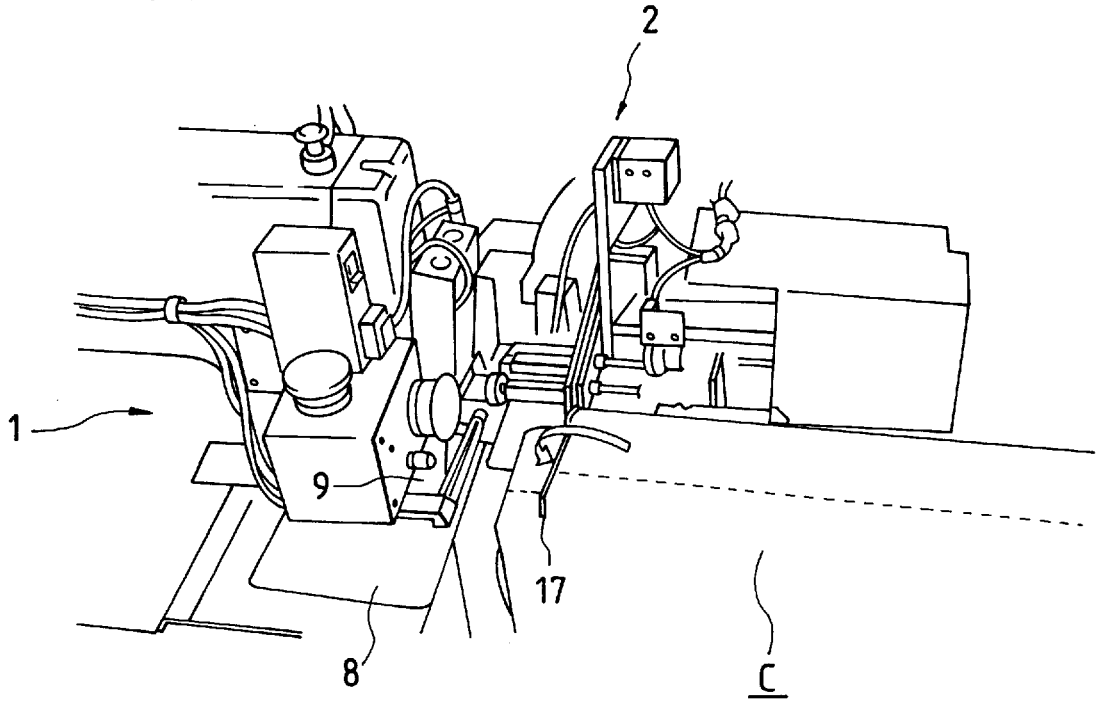
FIG. 11 is a perspective view showing the rotating operation of the pleat folding portion of the fabric, which operation follows what is shown in FIG. 10.
Figure 12:
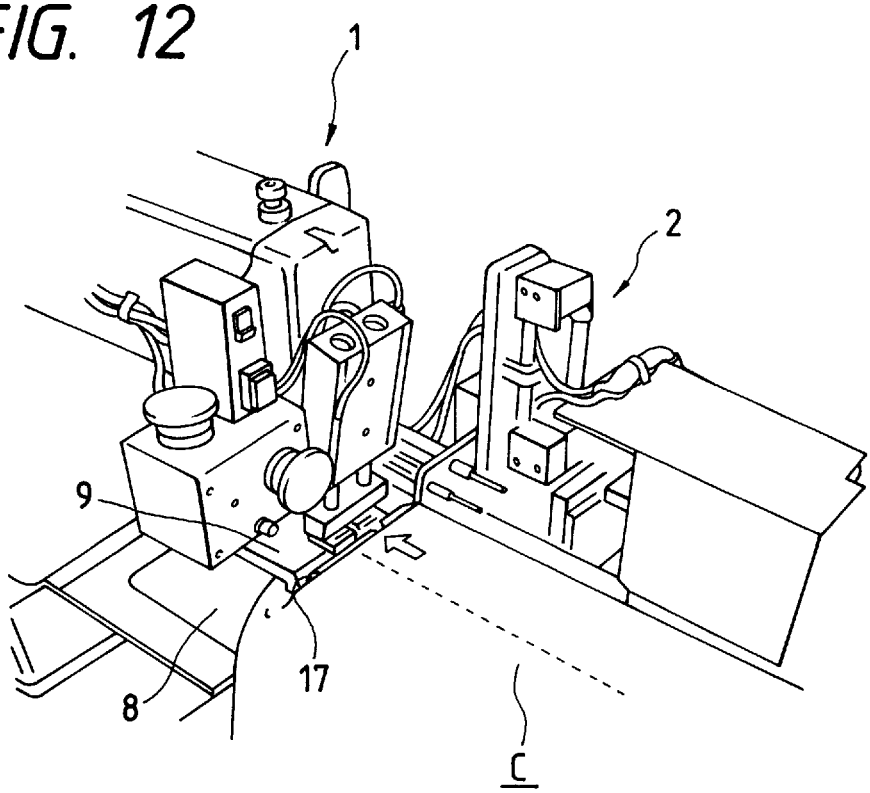
FIG. 12 is a perspective view showing a state in which the pleat folding portion of the fabric is inserted in the sewing machine, which state follows what is shown in FIG. 11.

The rotary plate of the pleat portion supply means 14 is turned for 90° toward the sewing machine 1 at STEP S24 as shown in FIG. 11 and simultaneously the slid member of the pleat portion supply means 14 is moved toward the sewing machine 1 as shown in FIG. 12. Then the pleat portion formed in the fabric as described above is inserted in the sewing part (between the throat plate 8 and the fabric hold-down means 9) of the sewing machine 1.

Then the next STEP S25 is followed and the sewing pattern is selected.

Subsequently as shown in FIG. 12, the needles 10, 10 are passed through the pleat portion of the fabric before the sewing machine 1 makes the fabric hold-down means 9 fix the pleat portion of the fabric onto the throat plate 8. When the needles 10, 10 are passed through the pleat portion of the fabric, they are passed therethrough without a hitch because open grooves have been formed in the lower folding plates 18, 18, 18, the upper folding plates 19, 19 and the fabric hold-down means 9.

Figure 13:
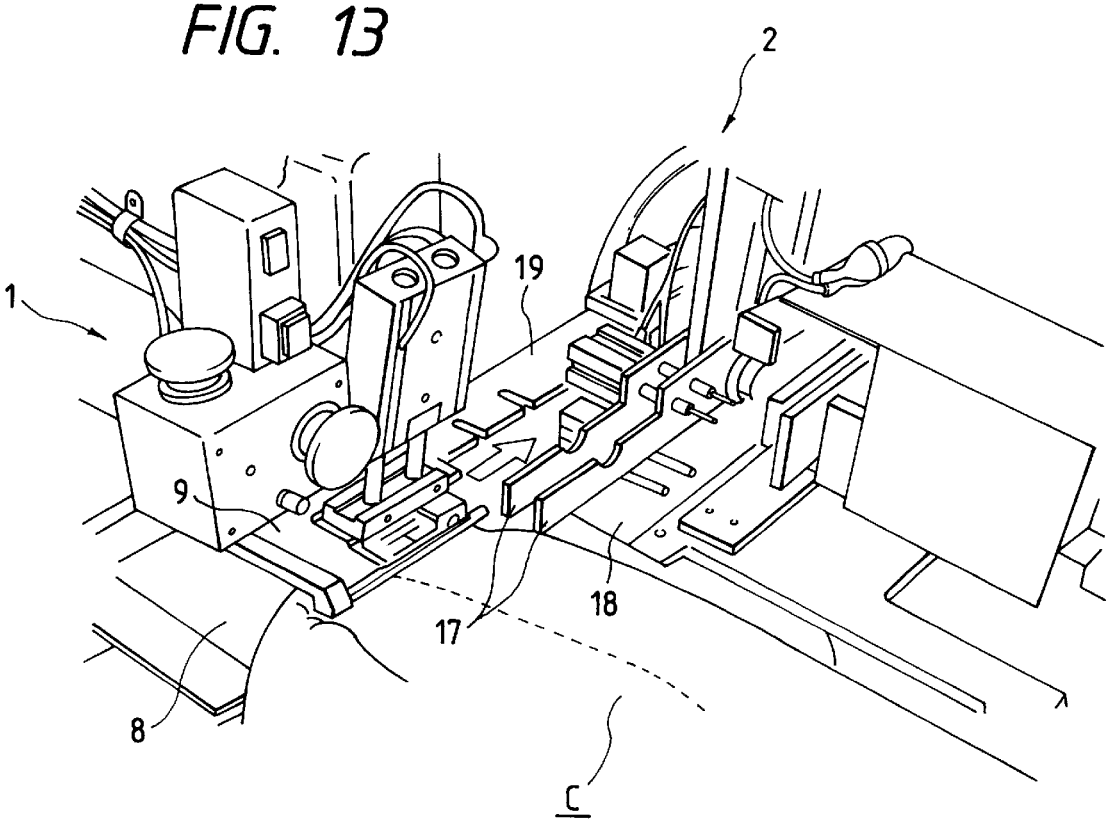
FIG. 13 is a perspective view showing the operation of retracting the pleat folding unit from the pleat folding portion of the fabric, which operation follows what is shown in FIG. 12.

As shown in FIG. 13 then, the operation of releasing from the fabric the lower folding plates 18, 18, 18 and the upper folding plates 19, 19 as well as that of pulling them therefrom are performed.

Further, the sewing machine 1 makes the fabric hold-down means 9 fix the pleat portion of the fabric onto the throat plate 8. Then the needles 10, 10 are pulled out when the pleat portion of the fabric is moved up while the operation of releasing from the fabric the front clamp plates 16 and the rear clamp plates 17 and that of pulling them therefrom are performed.

Further, the sewing pattern is selected at STEP S25.

When data concerning the full width, finishing width, the number of pleats, the number of crests, selvedge width and the like is fed, the data is automatically processed at the STEP S7, which results in the determination of the hook interval, one tack pleat length and the amplitude of the crest on the basis of the numerical values thus calculated.

The amplitude of the crest is determined by a degree of elevation of the lower folding plates 18, 18, 18 and the fittest crest-check sewing pattern for the amplitude of the crest is automatically selected. Each sewing pattern is fed before the sewing operation is performed and the depth of the base is also fed at the time of initial setting.

Pleat sewing at STEP S26 will subsequently be described.

Figure 15A:
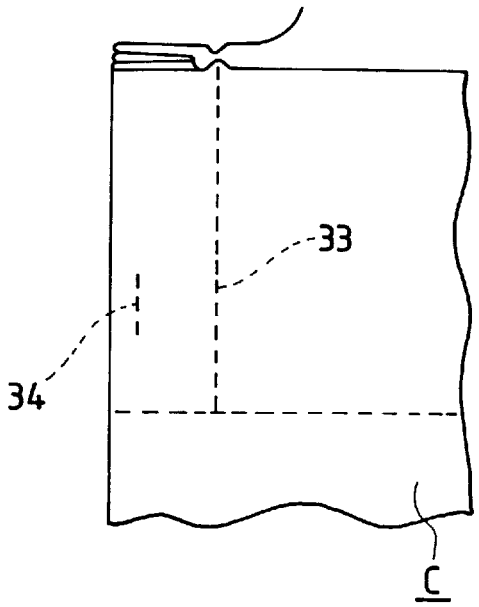
FIGS. 15(*a*) and 15(*b*) show the sewing process that follows what is shown in FIG. 14 wherein FIG. 15(*a*) is a plan view showing cases of pleat and crest-check sewing.
Figure 15B:
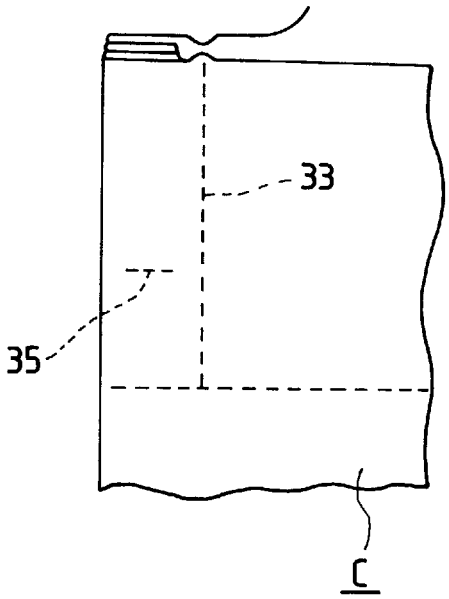
Figure 16:
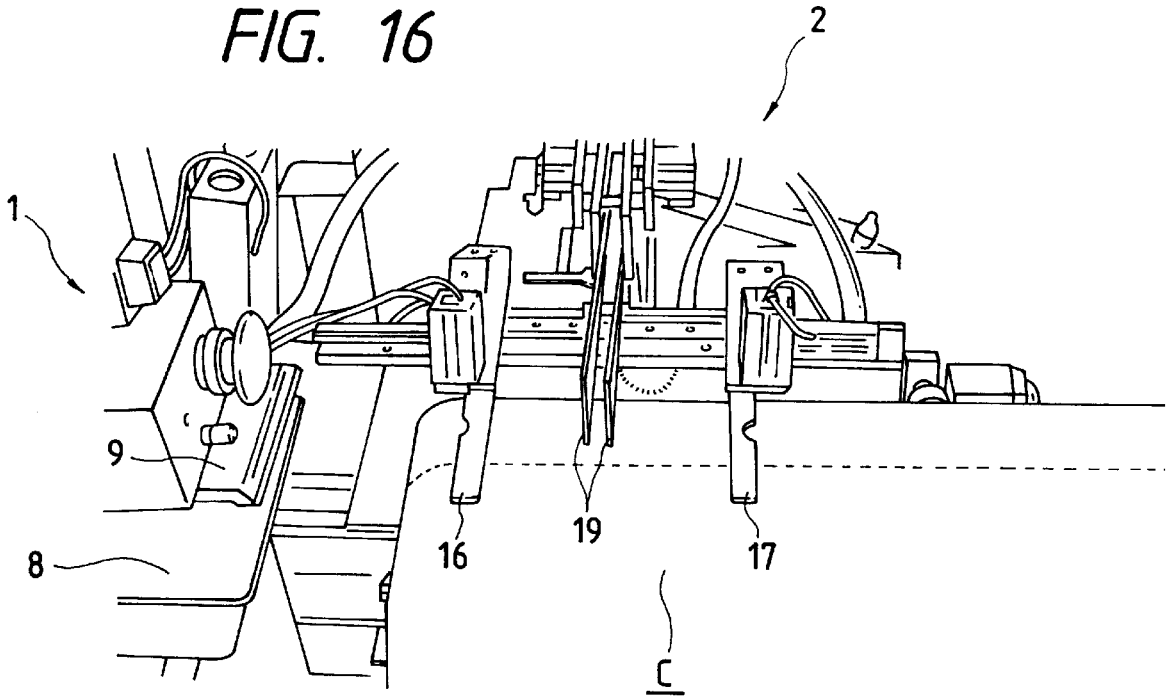
FIG. 16 is a perspective view showing a state in which the next portion is pleated, which state is followed by the thread-cutting operation after the sewing operation.
Figure 17:
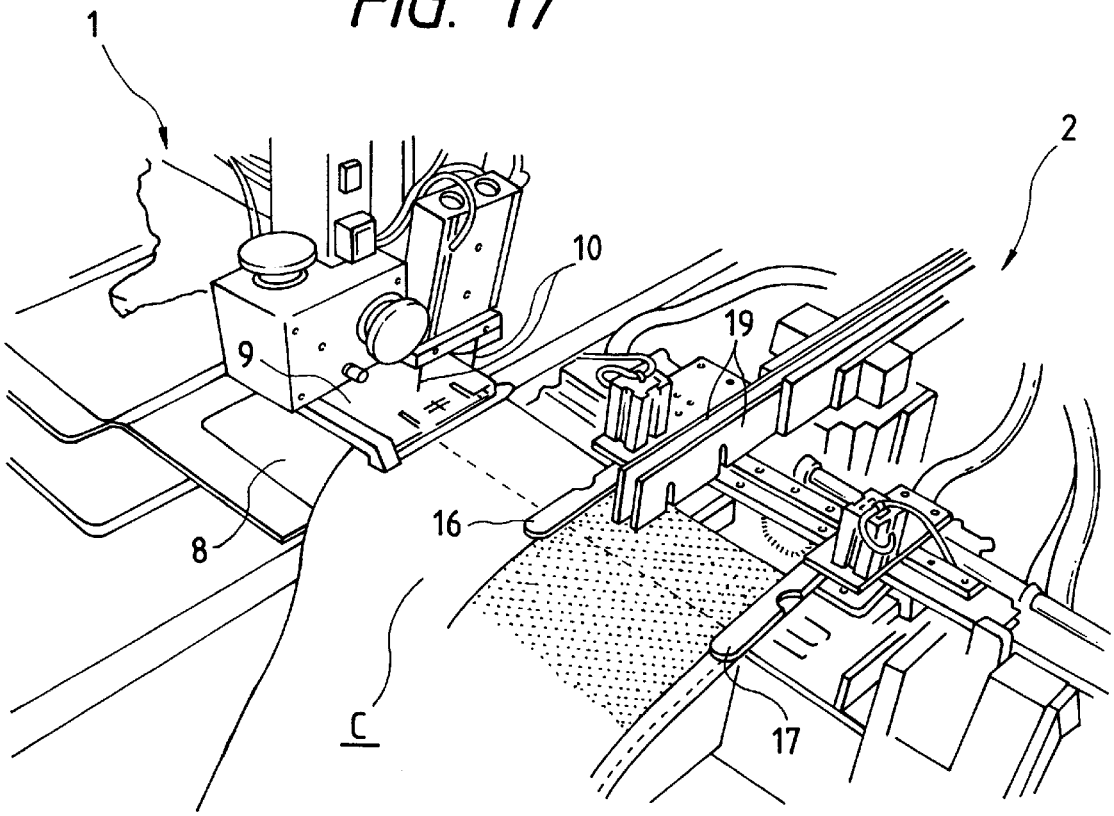
FIG. 17 is a perspective view of a state in which a portion to be pleated last is clamped.

Sewing needles 10 are used for sewing pleats and as shown in FIG. 15(*a*) and 15(*b*), a pleat sewing portion 33 is formed by sewing fabric C lengthwise along the edge of the pleat portion of the fabric.

Subsequently, parallel line sewing or inverted-T sewing is carried out.

More specifically, the parallel sewing is carried out immediately after the pleat sewing portion 33 is formed with the needle of the sewing machine 1 and as shown FIG. 15(*a*), the pleat sewing portion 33 is formed by sewing the pleat portion of the fabric in parallel to the pleat sewing portion 33.

Further, inverted-T sewing is carried out after the pleat sewing portion 33 is formed with the needle of the sewing machine 1 and as shown in FIG. 15(*b*), an inverted-T sewing portion 35 is formed by sewing the pleat portion of the fabric in a direction perpendicular to the direction in which the pleat sewing portion 33 is formed.

After the sewing operation like this is performed, an automatic thread cutting unit of the sewing machine 1 is used to cut the thread at STEP S27 and then the fabric hold-down means 9 returns to the origin.

Further, the rear-end holding member is moved back at STEP S28 and the sewing machine 1 makes the fabric hold-down means 9 fix the pleat portion of the fabric on the throat plate 8, so that the curtain fabric C is lightly stretched in the horizontal direction with respect to the rear-end holding member.

Further, a decision is made on whether regulating operation is needed at STEP S29.

If the decision is Yes, STEP S21 will be followed again unless the number of remaining pleats is 1 or 3 at STEP S32 since the computer of the sewing machine knows the number of remaining pleats and the pleat sewing operation is automatically and sequentially repeated in due course.

Figure 14:
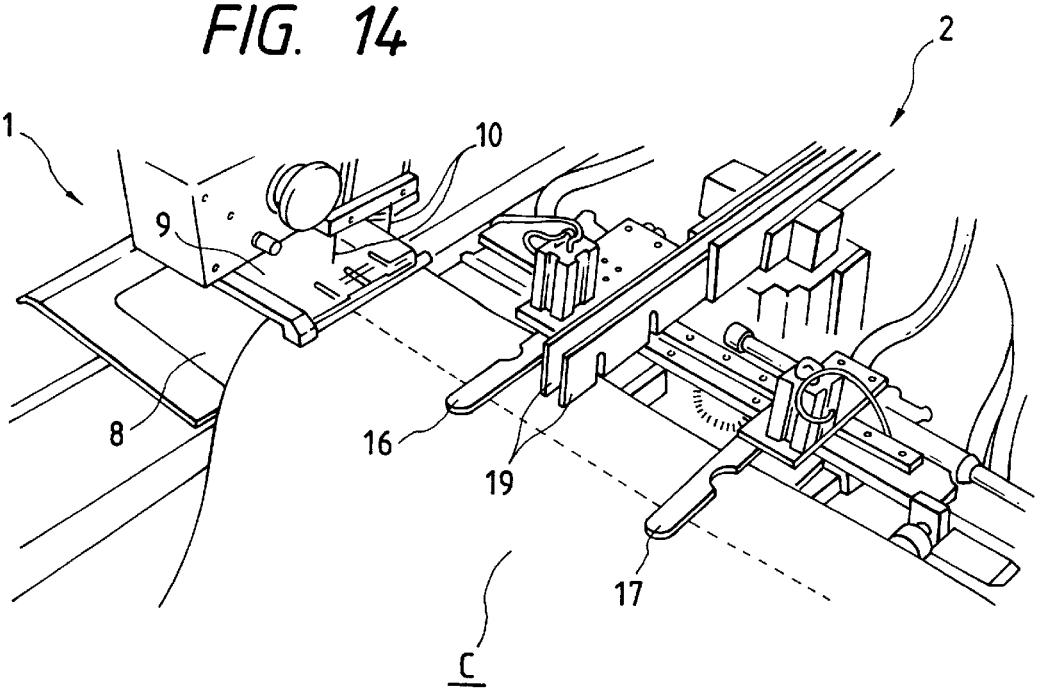
FIG. 14 is a perspective view showing the operation of moving upward a needle from the pleat folding portion of the fabric, which operation follows what is shown in FIG. 13.

In the case of the second pleat length portion and thereafter, the pleat forming-supplying unit 2 is reset to the initial condition as shown in FIG. 14 and while the sewing machine 1 keeps making the fabric hold-down means 9 fixing the pleat portion of the fabric on the throat plate 8, the pleat portion thereof is held by the front clamp plates 16 and the rear clamp plates 17, whereby the hook interval, that is, the space between the fabric hold-down means 9 of the sewing machine 1 and the front clamp plates 16 is dimensionally set accurate at all times.

When the number of remaining pleats is decided to be 3 at STEP S32, the finishing width is automatically regulated at STEP S33.

In other words, the finishing width of a curtain on order needs to be accurate and for this purpose, the computer is operated so that the finishing width is computed again from the width of the remaining fabric (which the computer recognizes from the position of the rear-end holding unit) before the final 3 tacks. The finishing width is regulated by setting each unit to the automatic registration mode without changing the hook interval and the selvedge width.

For example, 1-tack pleat length (the space between the front clamp plates 16 and the rear clamp plates 17) remains unchanged (i.e., without the alteration of the position) unless warp exists in the remaining fabric. Therefore, the amplitude of the crest is set equal to the prior amplitude.

Dimensions may differ from the actual ones very often due to the elongation and contraction of fabric being processed or the data obtained from manual measurement and fed without relying on the automatic measurement. During the regulation of the final 3 tacks then, the 1-tack pleat length varies because of the automatic measurement and the automatic registration, so that the amplitude of the crest may slightly be varied. In the example of FIG. 4, at least six pleats are slightly different in the amplitude of the crest from the last three pleats; however, one pleat has six sides in the case of three crests and errors are distributed to 18 sides or three times as many as the former case, so that the errors become almost negligible.

The aforementioned STEP S21 is followed again and the pleat sewing operation is successively repeated after the automatic finishing width is regulated.

When the decision made at STEP S29 is not the regulation of the operation (e.g., continuous operating mode), further, a decision is made on whether the final pleat is concerned at the next STEP S31. If it is not the final pleat, STEP S21 will be followed again and the automatic step of sewing pleats is resumed.

When the decision made at STEP S31 and STEP S32 above is to process the final pleat, the fabric is clamped by the front clamp plates 16, 16 and the rear clamp plates 17, 17, and the fabric hold-down means 9 moves down and stops in this condition.

Regarding the final pleat, the worker follows the procedure below including holding the rear end portion of the fabric, passing it between the front clamp plates 16, 16 and the rear clamp plates 17, 17, thrusting the upper end of the fabric up to the inner part (the right-hand side as viewed from the sewing machine) of the fabric guide, closing the front clamp pl ates 16, 16 by means of a foot switch, and clamping the fabric with the rear clamp plates 17, 17 by turning ON the foot switch while mating the end of the fabric with the rear ends of the rear clamp plates 17. The end of the fabric is mated with the rear ends of the rear clamp plates 17 when the selvedge width is 30 mm and it is set to 5 mm inward from the insides (forward) of the rear clamp plates 17 (up to the top of the semicircular portion of the rear clamp plate 17 of FIG. 17) when the selvedge width is 25 mm.

With the end of the fabric is not perfectly located at the above position, plus and minus values are input so as to fit the end of the fabric to the pleat length (the dimension between the front and rear clamp plates). Then automatic control is exerted again and the end of the fabric and the rear ends of the rear clamp plates 17 conform to each other. Further, the foot switch is turned ON to clamp the fabric with the rear clamp plates 17.

Consequently, the curtain is subjected to the steps of folding a pleat at STEP S41, inserting the fabric in the sewing machine at STEP S42, selecting a sewing pattern at STEP S43, carrying out pleat sewing and crest-check sewing at STEP S44 and cutting the thread at STEP S45, which is followed by the elevation of the fabric hold-down means 9 of the sewing machine 1, and then the sewing of the curtain is completed.

When the absence of the measurement setting mode (No) is decided at STEP S1, the aforementioned automatic measurement and the automatic full-width input are not executed. Therefore, items necessary for producing a pleated curtain on order such as the fall width, the finishing width, the number of pleats, the selvedge width and the number of crests are input and set at STEP S11.

Subsequently, the front end of the curtain fabric is held at STEP S12 and the rear-end holding member is moved backward at STEP S13 and used to clamp the curtain fabric at STEP S14.

Then the sewing machine is started and a series of operations are repeated as described above.

Although a description of a case where two pleats (one pleat before the last) are left is omitted from the flowchart at STEP S32, the adjustment of the movement at STEP S21 is not made since the intermediate holding members have moved backward and the process steps at STEP S22 and thereafter are followed.

As set forth above, the use of the automatic curtain pleat sewing machine according to this embodiment of the invention allows the automatic measurement of the full width of the curtain fabric C, whereby the respective dimensions of the pleat folding portion can automatically be set on the basis of the full width thus automatically measured. In other words, any kind of work excluding the setting of fabric, the inputting of data other than what is concerned with the full width and the sewing of the final pleat can be automated. Therefore, this automatic curtain pleat sewing machine is fit for producing curtains on order and productivity is improved.

When the pleated portion is formed, the operation of forming a pleat in the fabric is performed surely without trouble by means of the upper and lower folding plates 18, 18, 18, 19, 19 since the upper and lower clamp plates 21, 22 holding the rear end portion of the curtain fabric C are moved forward once beforehand. Further, the operation of inserting the pleated portion in the sewing part or the sewing machine 1 is smoothly performed to ensure that the fabric is held by the front and rear clamp plates 16, 17 in preparation for the formation of the next pleating portion.

Since adjustment is made so as to move the curtain fabric C in a direction perpendicular to the fabric-feeding direction by making the clamp plates 24, 24 hold the intermediate portion of the fabric, any difference in level is prevented from occurring on the edge face of the pleating portion particularly when the curtain fabric C is fed for the purpose of forming the next pleating portion. Thus pleat-sewing quality is made improvable.

Although the full width is designed so that it is automatically measured at all times according to this embodiment of the invention, the automatic curtain pleat sewing machine according to the present invention may be used in such a way that measured full width is input after the full width is measured beforehand.

Although a description has been given of a case where the fabric has a full width of 3 m–4 m, this dimension is optional and fabric having a full width of over 4 m may be dealt with by properly arranging a fabric table and an automatic measuring instrument.

More specifically, the method of initially inputting full width and the like without using the aforementioned measurement setting mode may be employed in a case where pleats are sewn in curtain fabric which is wider than the fabric table.

When fabric of 6 m is sewn on a fabric table of 4 m, for example, the computer always recognizes the remainder of the fabric and the number of pleats on condition that necessary items heave been input. Therefore, the rear-end holding member is moved back up to the rear end of the fabric table of 4 m with reference to STEP S28 above and when the sewing operation is applied to an about 4-meter position, the rear-end holding member is caused to open clamping with reference to STEP S28 while the fabric hold-down means 9 of the sewing machine 1 remains fixed to the sewing machine, is moved back up to the position of the remaining fabric (the position of 2 m) and stopped.

Then the rear-end holding member with reference to STEP S4 is made to clamp the end of the curtain fabric and started.

Further, the corresponding steps are followed as described above and when the whole work is completed, the processing as well as control is terminated.

In the case of long fabric having a full length of about 10 m, automatic measurement may be repeated twice or three times with about 3 m–4 m each time, for example, and automatic measurement is finally made. In this case, the rear-end holding unit clamps the fabric several times. In other words, the rear-end holding unit is designed to stay backward from the first pleat up to the last but one and wait for the last one at the end point of the remaining fabric. At the time of automatic measurement, however, the presence of absence of selvedge width is to be selected as occasion demands.

Bar codes may be used for the input items (finishing width, the number of pleats, the number of crests, selvedge width and the like) other than the full width. The use of bar codes to be fed in will ensure accuracy, prevent input errors and increase efficiency. In this case, full width may be fed in the form of a bar code at the time of normal setting.

In addition, specific structural particulars may needless to say be properly modified, if necessary.

As set forth above, since the automatic curtain pleat sewing machine according to the first aspect of the invention comprises the sewing machine and the pleat forming-supplying unit having forepart holding means for holding the leading end portion of the curtain fabric, the pleat folding means and the pleat portion supply means, the rear-end holding unit capable of moving the rear end portion of the curtain fabric forward and backward while holding the rear end portion thereof and the full-width measuring unit capable of measuring the full width of the curtain fabric when the rear-end holding unit moves backward, the full width of the curtain fabric cen be measured by the full-width measuring unit on the basis of the backward movement of the rear-end holding unit holding the rear end portion of the curtain fabric.

As the full width is automatically measurable, any kind of work can be automated other than setting fabric, inputting data and sewing the last pleat.

Therefore, the automatic curtain pleat sewing machine is particularly fit for the production of curtains on order and productivity is improvable.

Since the automatic curtain pleat sewing machine according to the second aspect of the invention is provided with the control unit for automatically setting the corresponding dimensions of the pleating portion formed by the pleat forming-supplying unit on the basis of the full width measured by the full-width measuring unit, in addition to the effect achievable by the invention according to the first aspect of the invention, the automatic curtain pleat sewing machine has the advantage of automatically setting the corresponding dimensions of the pleating portion by means of the control unit on the basis of the full width measured by the full-width measuring unit.

In a conventional case where pleats are sewn in a curtain on order, it has been common practice to measure the width of fabric with the placement of a 1-m scale on the table. With the end of long fabric held with left hand and with the intermediate portion thereof held with the right hand, for example, 1-m length is usually measured by matching the 0 cm point of the scale on the left-hand side with the 1 m point thereof on the right-hand side. Further, it is also commonly employed to measure the width of fabric successively by passing the knob point from the right-hand side to the left-hand side and by picking the vicinity of 1 m with the right hand and matching the left hand with 0 cm and the right hand to 1 m. However, these sorts of practice lack accuracy and besides precise dimensions are hardly obtainable because the degree of stretching tension of fabric tends to vary with the operator or the environmental situation.

According to the present invention, however, precise length of fabric is always fed because the stretching strength of fabric is always kept constant at the time of measurement. Therefore, the finishing dimensions are accurate because the difference between the remaining fabric recognized by the computer installed in this machine and the actual length of the remaining fabric is extremely small at all times. Even, in case of the adjusting operation mode, when automatic adjustment is applied before 3-tack, adjustment is scarcely observable in the case of moving the front and rear clamp plates, which signifies that the automatic adjustment can be almost nearly dispensed with. Therefore, there is no possibility of causing the height of the pleat crest before 3-tack and that of the final 3-tack to go wrong, so that high-quality finished curtains are available.

In the automatic curtain pleat sewing machine according to the third aspect of the invention, the rear-end holding unit moves forward so as to loosely stretch the curtain fabric before the pleated portion of the curtain fabric is formed by the pleat forming-supplying unit. Therefore, in addition to the effect achievable by the invention according to either first or second aspects of the invention, the advantage is that the formation of the pleating portion is smoothly made since the rear-end holding unit holding the rear end portion of the curtain fabric moves forward so as to loosely stretch the curtain fabric when the pleating portion is formed.

In the automatic curtain pleat sewing machine according to the fourth aspect of the invention, since the rear-end holding unit moves backward after the termination of the sewing operation performed by the sewing machine, in addition to the effect achievable by the invention according to one of the first to third aspects of the invention, the advantage is that the curtain fabric has a certain degree of stiffness, which results in making the clamp plates recurrent without trouble, thus obviating errors in hook interval dimensions.

In the automatic curtain pleat sewing machine according to a fifth aspect of the invention, further, since the intermediate portion adjusting unit is used for holding the intermediate portion of the curtain fabric and making adjustment so as to move the curtain fabric in a direction perpendicular to the fabric-feeding direction when the curtain fabric is fed in preparation for the formation of the next pleated portion thereof. Therefore, in addition to the effect achievable by the invention according to one of the first to fourth aspects of the invention, the advantage is that pleat-sewing quality is made improvable as any difference in level is prevented from occurring on the edge face of the pleat folding portion by holding the intermediate portion of the curtain fabric and making adjustment so as to move the curtain fabric in a direction perpendicular to the fabric-feeding direction when the curtain fabric is fed in preparation for the formation of the next pleated portion thereof.

In the automatic curtain pleat sewing machine according to a six aspect of the invention, further, since the fabric feed guide unit is located downward along the fabric table when the full width of the curtain fabric is measured and moves upward and forward and backward in synchronization with the rear-end holding unit during the sewing operation. Therefore, in addition to the effect achievable by the invention according to one of the first to fifth aspects, the advantage is that the full width of the fabric is smoothly measured as the fabric feed guide unit stays downward.

During the sewing operation, further, the fabric is prevented from hanging down to a considerable degree as the fabric feed guide unit moves upward, whereby the adjustment of the movement of the intermediate portion holding member and the time required therefor are minimized with the effect of increasing efficiency. The further advantage is that, during the sewing operation when the fabric feed guide unit is moved upward, the weight of the fabric applied to the rear-end holding member is reducible as the fabric feed guide unit moves forward and backward in synchronization with the rear-end holding unit.

What is claimed is:

1. An automatic curtain pleat sewing apparatus for forming and sewing pleats for a curtain, comprising:

a sewing machine having sewing needles;

a pleat forming-supplying unit having forpart holding means for holding the leading end portion of the curtain fabric and the remainder thereof;

pleat folding means for pleating the curtain fabric thus held by said forepart holding means;

pleat portion supply means for integrally rotating said forepart holding means and said pleat folding means so as to insert the pleated portion of the curtain fabric in the sewing part of said sewing machine;

a rear-end holding unit for moving the rear end portion of the curtain fabric forward and backward while holding the rear end portion thereof; and a full-width measuring unit for measuring the full width of the curtain fabric when said rear-end holding unit moves backward.

2. The automatic curtain pleat sewing apparatus according to claim 1, further comprising a control unit for automatically setting the dimensions of the pleated portion to be formed by said pleat forming-supplying unit on the basis of the full width measured by said full-width measuring unit.

3. The automatic curtain pleat sewing apparatus according to claim 1, wherein said rear-end holding unit moves forward so as to loosely stretch the curtain fabric before said pleated portion of the curtain fabric is formed by said pleat forming-supplying unit.

4. The automatic curtain pleat sewing apparatus according to claim 1, wherein said rear-end holding unit moves backward after the termination of the sewing operation by said sewing machine.

5. The automatic curtain pleat sewing apparatus according to claim 1, further comprising an intermediate portion adjusting unit for holding the intermediate portion of the curtain fabric and making adjustment so as to move the curtain fabric in a direction perpendicular to the fabric-feeding direction when the curtain fabric is fed in preparation for the formation of the next pleated portion thereof.

6. The automatic curtain pleat sewing apparatus according to claim 1, further comprising a fabric feed guide unit which is located downward when the full width of the curtain fabric is measured and which moves upward and moves forward and backward in synchronization with said rear-end holding unit during the sewing operation.

7. The automatic curtain pleat sewing apparatus according to claim 1, further comprising a fabric stage having a lateral flat shape.

8. The automatic curtain pleat sewing apparatus according to claim 7, wherein said pleat forming-supplying unit is incorporated with the body of the sewing nachine, and said rear-end holding unit and said full-width measuring unit are incorporated with said fabric stage which mounts the curtain fabric that has been spread out.

9. The automatic curtain pleat sewing apparatus according to claim 7, including an opening formed on a side of said fabric stage adapted to expose said forepart holding means, said pleat folding means and said pleat portion supply means of the pleat forming-supply unit.

* * * * *